US010676944B2

(12) United States Patent
Nguyen

(10) Patent No.: US 10,676,944 B2
(45) Date of Patent: Jun. 9, 2020

(54) LIFTING CART FOR BUILDING CONSTRUCTION

(71) Applicant: Nhon Hoa Nguyen, Bankstown (AU)

(72) Inventor: Nhon Hoa Nguyen, Bankstown (AU)

( * ) Notice: Subject to any disclaimer, the term of this patent is extended or adjusted under 35 U.S.C. 154(b) by 0 days.

(21) Appl. No.: 16/188,744

(22) Filed: Nov. 13, 2018

(65) Prior Publication Data

US 2019/0145113 A1 May 16, 2019

Related U.S. Application Data

(60) Provisional application No. 62/584,923, filed on Nov. 13, 2017.

(51) Int. Cl.

| | |
|---|---|
| ***B62B 3/10*** | (2006.01) |
| ***E04G 21/16*** | (2006.01) |
| ***B62B 3/04*** | (2006.01) |
| ***E04F 21/18*** | (2006.01) |

(52) U.S. Cl.

CPC ..... *E04G 21/168* (2013.01); *E04F 21/1816* (2013.01); *E04F 21/1822* (2013.01); *E04F 21/1844* (2013.01)

(58) Field of Classification Search

CPC .... E04F 21/18; E04F 21/1822; E04G 21/167; E04G 21/168; E04G 21/16; C10B 25/14; C10B 25/12; B62B 3/108; B62B 2203/10; B66F 9/18; B66F 9/06

See application file for complete search history.

(56) References Cited

U.S. PATENT DOCUMENTS

| | | | | | |
|---|---|---|---|---|---|
| 2,468,326 | A * | 4/1949 | Gleason | B66F 9/125 | 414/641 |
| 2,603,368 | A * | 7/1952 | Vance | B66F 9/184 | 414/620 |
| 2,828,870 | A * | 4/1958 | Corley | B66C 7/00 | 414/11 |
| 3,002,639 | A * | 10/1961 | Cavanagh | B66F 9/188 | 414/623 |
| 3,738,518 | A * | 6/1973 | Outsen, Jr. | B66F 9/06 | 414/627 |
| 3,954,189 | A * | 5/1976 | Sherritt | B60P 3/00 | 414/11 |
| 3,977,534 | A * | 8/1976 | Blake | E04F 21/1894 | 414/11 |
| 4,095,714 | A * | 6/1978 | Schuster | B66F 9/125 | 414/607 |

(Continued)

FOREIGN PATENT DOCUMENTS

| | | | |
|---|---|---|---|
| EP | 1645484 | A2 * | 4/2006 |
| WO | WO-9315290 | A1 * | 8/1993 |

*Primary Examiner* — Gregory W Adams
(74) *Attorney, Agent, or Firm* — Tue Nguyen

(57) ABSTRACT

A lifting cart for assist in building construction processes using precast wall panels can include a panel handling mechanism coupled to a movable vehicle. The panel handling mechanism can include a clamping mechanism, a rotational mechanism, a linear mechanism, and a tilting mechanism. The movable vehicle can include two sets of wheels configured to move the vehicle in perpendicular directions. The lifting cart can handle the precast wall panels, from a wall panel package delivered to the construction site to the final location of the wall panels between beams of the building frame.

8 Claims, 29 Drawing Sheets

(56) References Cited

U.S. PATENT DOCUMENTS

| | | | | | |
|---|---|---|---|---|---|
| 4,279,564 | A * | 7/1981 | Weinert | B66F 9/183 | 414/621 |
| 4,285,626 | A * | 8/1981 | Donato | B66F 9/18 | 414/622 |
| 4,394,106 | A * | 7/1983 | Frees | B65G 49/061 | 294/67.22 |
| 5,927,932 | A * | 7/1999 | Seaberg | B66F 9/125 | 414/620 |
| 6,651,717 | B2 * | 11/2003 | Matsumoto | B29C 63/0034 | 156/379 |
| 7,025,053 | B1 * | 4/2006 | Altamirano | B23D 47/025 | 125/13.01 |
| 7,597,527 | B2 * | 10/2009 | Rodriguez | B66F 9/07568 | 105/177 |
| 8,146,971 | B2 * | 4/2012 | LaValley | E21B 19/14 | 294/81.61 |
| 8,632,296 | B1 * | 1/2014 | Binford | B63B 27/02 | 414/803 |
| 8,966,860 | B2 * | 3/2015 | Hovenier | E04G 21/167 | 52/127.2 |
| 2019/0047458 | A1 * | 2/2019 | Hall, Jr. | B66F 7/0683 | |

* cited by examiner

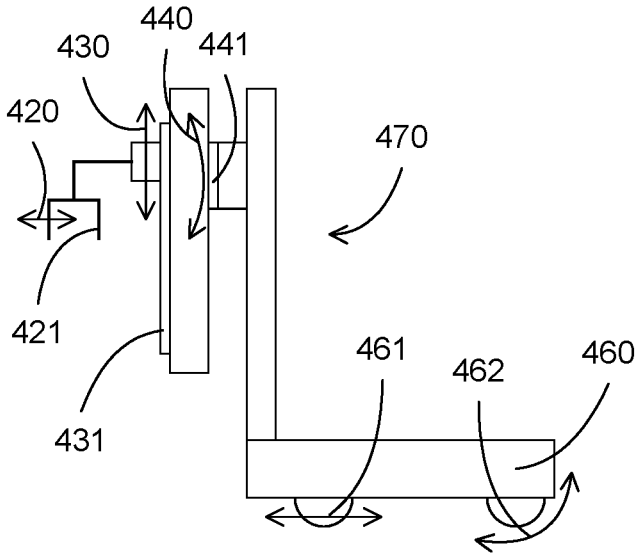
FIG. 4A
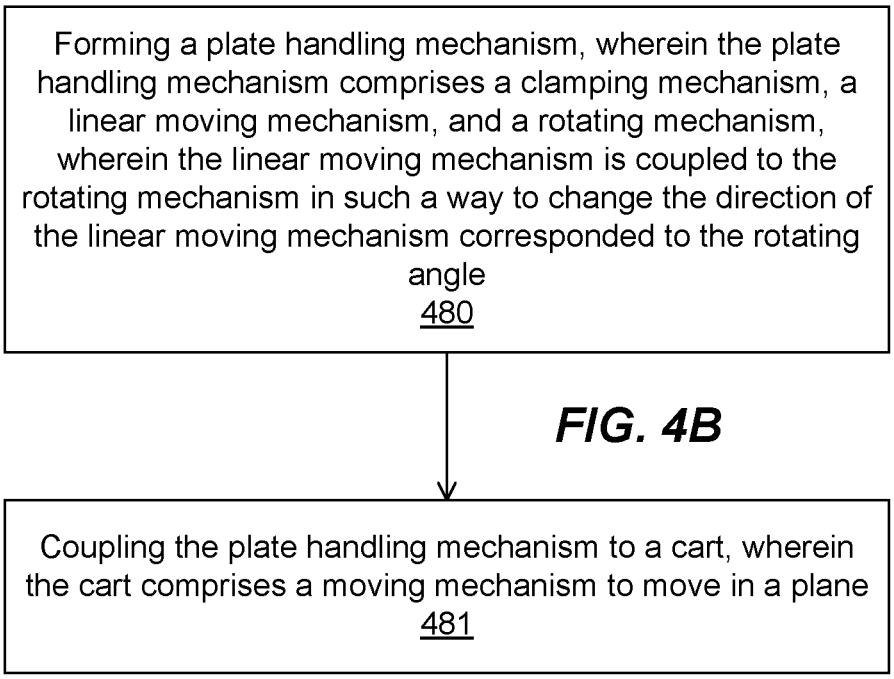
FIG. 4B
FIG. 4C

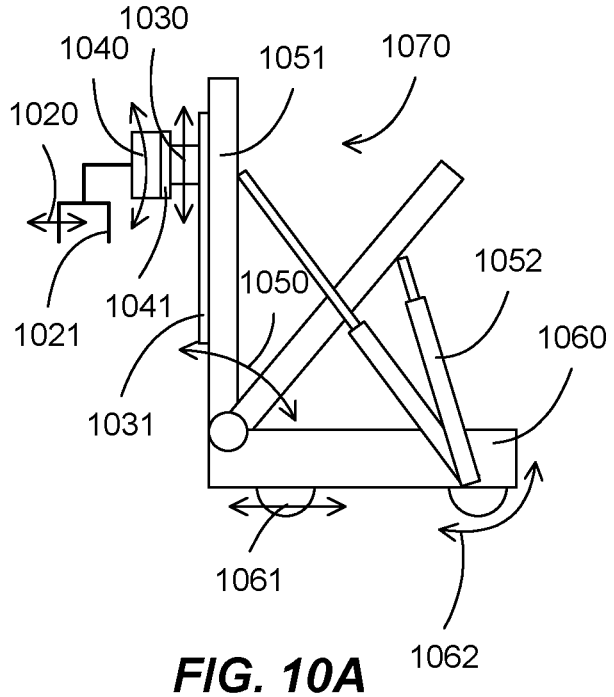

FIG. 10A

Forming a plate handling mechanism, wherein the plate handling mechanism comprises a clamping mechanism, a linear moving mechanism, a rotating mechanism, and a tilting mechanism, wherein the linear moving mechanism is coupled to the rotating mechanism in such a way as not to change the direction of the linear moving mechanism regardless of the rotating angle
1080

↓

Coupling the plate handling mechanism to a cart, wherein the cart comprises a moving mechanism to move in a plane
1081

FIG. 10B

Coupling a handling mechanism to a movable vehicle, wherein the handling mechanism is configured to move a panel in non-planar directions, wherein the movable vehicle is configured to move the panel in planar directions
1800

*FIG. 18A*

Forming a system to assist in handling a wall panel, wherein the system comprises a panel handling assembly coupled to a set of wheels,
wherein the panel handling assembly comprises a clamping mechanism for holding the panel, a lifting mechanism for moving the panel in a vertical direction, a rotation mechanism to rotate the panel to a proper orientation for assembly,
wherein the set of wheels comprises a wheel assembly configured to move the vehicle in planar directions including a first planar direction, wherein the set of wheels comprises a second wheel assembly configured to move the vehicle in a second planar direction substantially perpendicular to the first planar direction, wherein the vehicle comprises a mechanism for switching between the first and second wheel assemblies
1820

*FIG. 18B*

Lifting and rotating a panel using a handling mechanism
1840

↓

Moving the panel in planar directions using a movable vehicle having two perpendicular sets of wheels
1850

*FIG. 18C*

LIFTING CART FOR BUILDING CONSTRUCTION

The present application claims priority from U.S. Provisional Patent Application Ser. No. 62/584,923, filed on Nov. 13, 2017, which is incorporated by reference in its entirety.

Precast wall panels can provide on-site construction of buildings with improved efficiency, such as lower labor costs and faster construction cycles. Precast wall panels using lightweight concrete materials can result in substantial savings in construction costs, as compared to traditional brick walls and conventional concrete block work. In addition, a smaller number of workers can be used with less or even no skilled workers.

The precast wall panel can be used to form room-high partition wall panels having no-load bearing. The precast wall panels can be room-high, e.g., 2-3 m long, and about 0.6 m wide. The precast wall panels can have completely flat surface, thus no surface conditioning, e.g., surface plastering, is needed. The precast wall panels can have cavities, offering ducts for electrical wires and water pipes.

However, even with cavities and light weight technology, the precast wall panels can be heavy, e.g., having an area density of about 140 kg/m$^2$ for a typical 0.1 m thickness wall panel. A precast wall panel can be too heavy for one person to handle, and lifting a precast wall panel with two persons can require tremendous effort.

Thus there is a need for a lifting cart for handling the precast wall panels to assist in the building construction, e.g., in the installation of wall partitions.

SUMMARY

In some embodiments, the present invention discloses a lifting cart for assist in building construction processes using precast wall panels. The lifting cart can include a panel handling mechanism coupled to a movable vehicle. The panel handling mechanism can include a clamping mechanism for clamping on the panel, a rotational mechanism for rotating the panel in a first direction perpendicular to a plane of the panel, and a linear mechanism for moving the panel in a second direction parallel to a plane of the panel.

In some embodiments, the present invention discloses a lifting cart for assist in building construction processes using precast wall panels. The lifting cart can include a panel handling mechanism coupled to a movable vehicle. The movable vehicle can include a first set of wheels configured to move in a first straight direction, a second set of wheels configured to move in a second straight direction, wherein the second straight direction is perpendicular to the first straight direction, and an activation mechanism to switch moving the vehicle between using the first set of wheels and using the second set of wheels.

In some embodiments, the present invention discloses a lifting cart for assist in building construction processes using precast wall panels. The lifting cart can include a body, a plate handling assembly coupled to the body, a first set of wheels and a second set of wheels configured to move in perpendicular directions, and an activation mechanism configured to switch between the perpendicular directions.

BRIEF DESCRIPTION OF THE DRAWINGS

FIGS. 4A-4C illustrate a lifting cart configuration according to some embodiments.

FIGS. 10A-10B illustrate a lifting cart configuration according to some embodiments.

FIGS. 18A-18C illustrate flow charts for a lifting cart according to some embodiments.

DETAILED DESCRIPTION OF THE EMBODIMENTS

In some embodiments, the present invention discloses a lifting cart for assist in building construction processes using precast wall panels. The lifting cart can handle the precast wall panels, for example, from a wall panel package delivered to the construction site to the final location of the wall panels between beams of the building frame. Thus the lifting cart can be configured to handle the heavy lifting and moving of the wall panels, leaving the construction workers with the light duty jobs of securing the wall panels to the building frame, and of finalizing the building interior and exterior.

Figure 1:
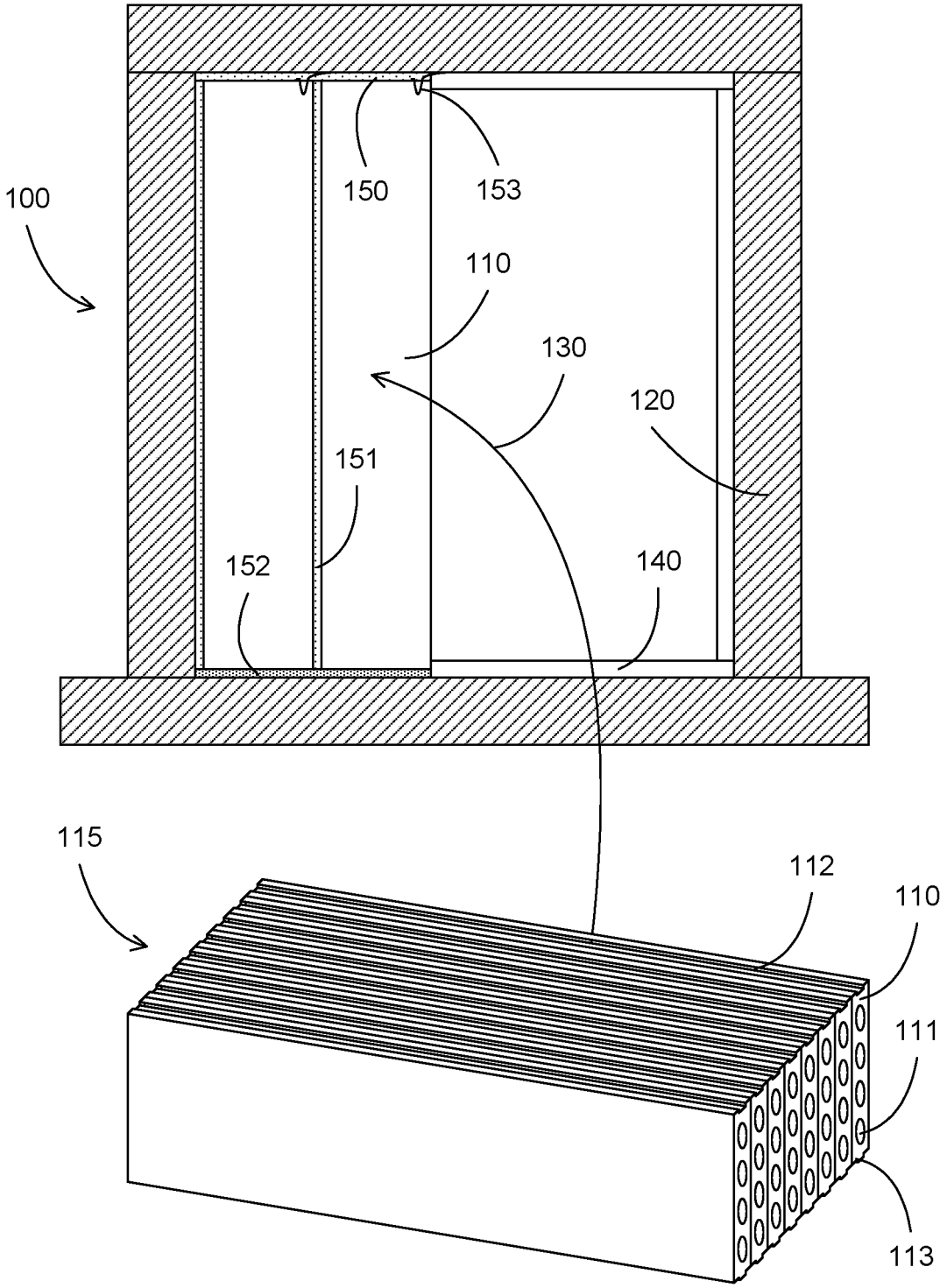
FIG. 1 illustrates a configuration for a building construction using precast wall panels according to some embodiments.

FIG. 1 illustrates a configuration for a building construction using precast wall panels according to some embodiments. A construction site can include a frame 100 of a building. The frame can be constructed on a foundation. The frame can include multiple beams 120, e.g., vertical beams and horizontal beams, forming a framework of the building, such as forming the load bearing skeleton for the building. The wall panels can be installed between the beams. Since the beams are configured to sustain the load of the building, the wall panels can be under no heavy load from the building.

Wall panel construction can be prepared, for example, by installing edge stops for the wall panels to rest on. The edge stops 140 can include small bars, temporarily secured to the frame of the building. The edge stop bars can delimiter the plane of the wall panels, e.g., the wall panels can be pushed against the edge stop bars to form a wall. For example, a wall panel can be positioned touching a top edge stop bar and a bottom edge stop bar, before being secured in place. Afterward, the edge stop bars can be removed.

A side-by-side stack 115 of precast wall panels 110 can be delivered to the construction site, for example, by a truck for long distances and by a fork lift for short distances. The dimension of the wall panels can include a length that is comparable with the height of the rooms, e.g., the distance from the foundation to the ceiling beams for the first floor, or the distance from the floor beams to the ceiling beams for subsequent floors. Typically, the length of the wall panels can be between 2 and 3 m, but can be up to 20 m, e.g., less than 20 m, less than 15 m, less than 10 m, or less than 5 m, depending on the building design. The width of the wall panels can be designed for ease of manufacturing or transportation, such as 0.6 m, 0.8 m, 1 m, or 1.2 m. The thickness of the wall panels can be 0.05 m, 0.1 m, 0.15 m, or 0.2 m. For example, the wall panels can be less than 50 mm, less than 40 mm, less than 30 mm, less than 20 mm, or less than 10 mm as compared to the room height, for ease of assembling. The wall panel height can be between 50 mm and 10 mm less than the room height.

The wall panels can include tongue 113 and groove 112 for mating together. The wall panels can include channels, such as interior channels 111 running along the length of the wall panels. The channels can run along the length of the wall panels, e.g., the longest side of the wall panels, such as along the vertical direction from the ceiling to the floor when installed. The channels can run along the width of the wall panels, e.g., the shorter side of the wall panels, such as along the horizontal direction parallel to building floor when installed.

The wall panels can be precast to sizes, e.g., the molds of the wall panels are designed according to building sizes, or the building is designed based on the available sizes of the wall panels. Alternatively, the wall panels can be precast from a cement mixture that can allow shaping, such as sawing, so that the wall panels can be cut to size.

The wall panels can be mounted against the edge stop bars on the building frame. The wall panels can have tongue and groove edges for coupling together. Side-by-side wall panels can be glued together, for example, using appropriate gluing agent 151. The gluing thickness can be less than 2 mm, such as between 1 mm and 2 mm. For example, a side edge of a wall panel, e.g., a surface of a length and a thickness, can be coated with the gluing agent. A new panel can be brought to the glued panel, with a side edge facing the glued side edge. The new panel can be pressed against the glued panel, until the glue is set, to secure the two panels together.

The new panel can be secured in place at the top and bottom sides to the building frame by using wooden wedges. Afterward, the gaps 150 between the top sides of the wall panels and the ceiling of the building can be covered by an insulation material, such as polyurethane foam. Alternatively, a gluing agent can be used to secure the top sides of the wall panels to the ceiling. After applying the gluing agent, the wall panels can be pushed against the ceiling to squeeze out excess gluing agent. The gluing thickness can be less than 2 mm. The gaps 152 between the bottom sides of the wall panels and the floor of the building can be covered by a cement mixture. The wooden wedges then can be removed.

The precast wall panels can have a cement material, e.g., forming concrete wall panels. Thus the wall panels may not be subjected to any heavy load, e.g., which can be highly suitable for forming partitions between frame of a building. During storage or transport, the wall panels also are arranged with minimum loads on the wall panels. Thus the wall panels can be placed side-by-side, e.g., the wall panels are not stacked on top of each other, but instead placed in a side-by-side configuration. There can be no external load on the wall panels in this storage configuration. Alternatively, another side-by-side stack of wall panels can be placed on top of the side-by-side stack, e.g., each wall panel can be under the weight of another wall panel. The wall panels can be placed with the length, e.g., the longer side, touching the ground, for example, for stability.

In some embodiments, the wall panels can have reinforced steel embedded within the cement material, for example, to increase the strength of the wall panels. The steel reinforced wall panels can be subjected to heavy loads. The wall panels can be precast with channels, such as interior channels or exterior channels.

The wall panels can be manually installed, e.g., using construction workers. Due to the heavy weight of the wall panels, at least two workers are needed to handle the wall panels. In addition, it can be a strenuous work for aligning the wall panels, e.g., for moving the wall panels next to each other to form a complete wall.

In some embodiments, the present invention discloses a lifting cart for handling the wall panels. The lifting cart can be operated by one worker, and can move the wall panels from the package configuration to the installed positions, including the large movements and the fine alignment of the wall panels.

The lifting cart can be used for picking up a wall panel 110, for example, from the side-by-side stack 115 of the wall panels. The lifting cart can lift up the wall panel, and rotate the wall panel to the installed position, such as rotating an angle about 90 degrees if the wall panel is stacked on its length, and to be installed on its width. The lifting cart then moves the wall panel to the proper position, e.g., next to a beam of the frame or next to another wall panel. The lifting can place the wall panel with the shorter side, e.g., the width, facing the ground. The frame beam, the already-installed wall panel, or the newly installed wall panel can be coated with a layer of adhesive, e.g., gluing agent, to bonding the wall panel with the frame beam or with the already-installed all panel. The alignment of the new wall panel can be performed by the lifting cart, e.g., the lifting cart can move the wall panel at large distance for transferring the wall panel as well as small distance for alignment the wall panel.

A worker then can secure the wall panel into place, such as by coupling an attachment 153 to the top side of the wall panel and then screwing or nailing the attachment to the ceiling beam, and by putting wooden wedges at the bottom side of the wall panel. After one or multiple wall panels are placed, insulation foam can be applied to the top gaps, and cement mixture can be applied to the bottom gaps. After the wall is complete, surface conditioning can be applied to the wall, and interior works such as electrical wiring and water lines can be performed.

The lifting cart can continue moving and placing other wall panels into their proper positions. The use of the lifting cart can assist the workers in handling the heavy wall panels, leaving the workers with the light jobs of securing the wall panels to the building frame.

Figure 2A:
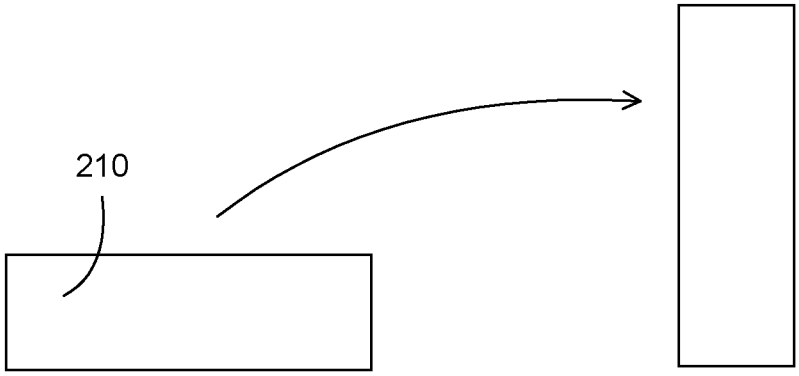
FIGS. 2A-2B illustrate processes for installing a wall panel according to some embodiments.
Figure 2B:
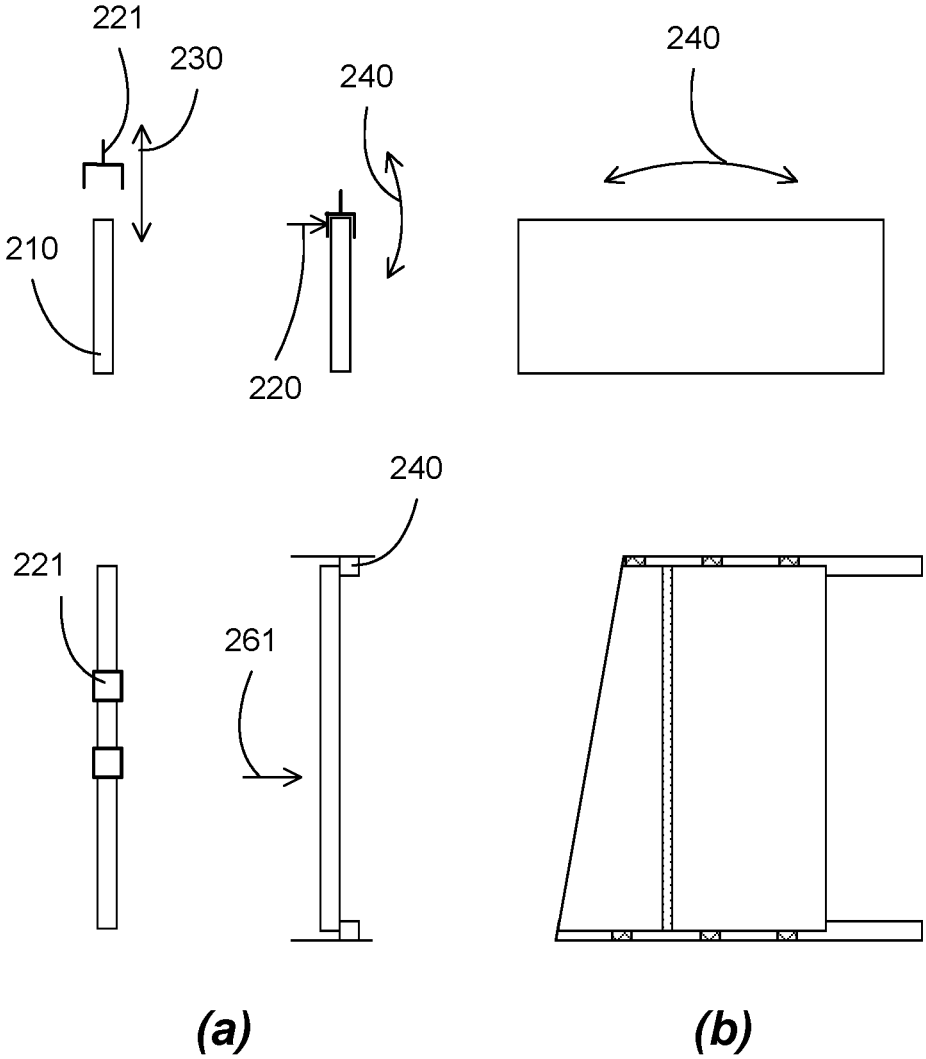

FIGS. 2A-2B illustrate processes for installing a wall panel according to some embodiments. The wall panels can be typically stored in a horizontal direction, e.g., the length or the longer side of the wall panels is contacting the ground, for stability and stress reduction on the precast wall panels. The wall panels are then installed in a vertical direction, e.g., the width or the shorter side of the wall panels is contacting the ground, so that the wall panels can be positioned side by side. As shown in FIG. 2A, a wall panel 210 can be stored in a horizontal direction, and then can be rotated, along a direction perpendicular to the planar surface of the wall panel. The rotation angle can be about 90 degrees, e.g., the wall panels can be of rectangular shape.

FIG. 2B(a) show one side view and FIG. 2B(b) show another side view of a process for installing a wall panel. A wall panel 210 can be stacked side by side, e.g., in a horizontal direction facing the ground. A clamp 221, from a handling mechanism on a lifting cart, can be lowered 230 on a wall panel. The clamp can be tightened, e.g., the jaws of the clamp can move 220 toward each other to secure on the wall panel. The handling mechanism can rotate 240 the wall panel, so that the width of the wall panel facing the ground. The handling mechanism can lift the wall panel up, to clear the ground before rotating. The handling mechanism can also tilt the wall panel backward, to reduce the load on the clamp. For example, after tilting, the wall panel can rest on a set of wheels, which can allow rotating the wall panel with minimum force on the clamp.

The lifting cart can move 261 the wall panel into the installed position, e.g., against edge stop bars 240 mounted on the frame. Glue, insulation foam, and cement coating can be used to seal any gaps between the wall panels and the frame.

In some embodiments, the lifting cart can assist in the handling of the wall panels, since the wall panels can be heavy. The lifting cart can also allow precision alignments of the wall panels, since the workers can adjust the positions of the wall panels without using any heavy work.

Figure 3:
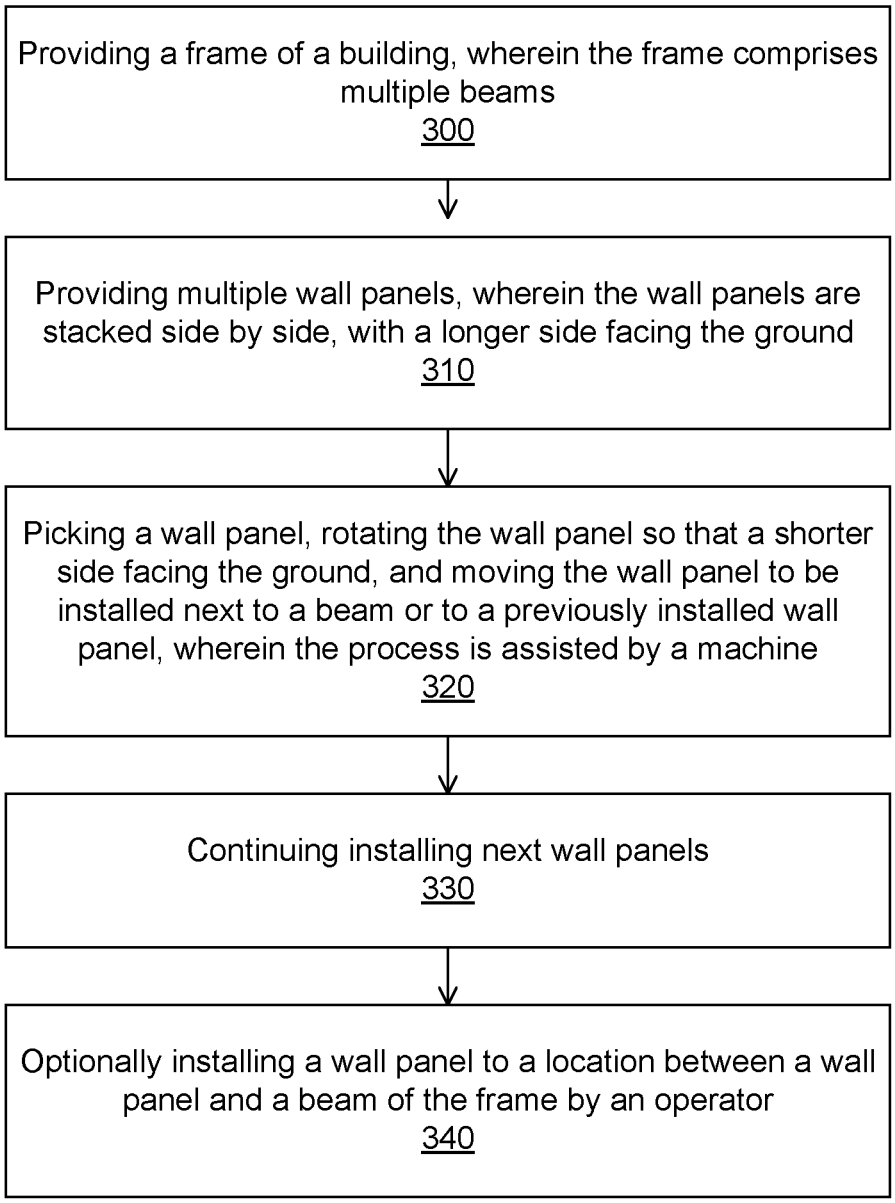
FIG. 3 illustrates a flow chart for constructing a building using precast walls panels according to some embodiments.

FIG. 3 illustrates a flow chart for constructing a building using precast walls panels according to some embodiments. Operation 300 provides a frame of a building, wherein the frame comprises multiple beams. The beams can be concrete beams reinforced with steel rods. The frame can be constructed to accept the weight of the building, leaving the wall panels with no forces or stresses, e.g., the wall panels are configured for partitions without under any heavy load.

Operation 310 provides multiple wall panels, wherein the wall panels are preferably stacked side by side, with a longer side and a thickness facing the ground, e.g., the panels are not stacked on each other. The wall panels can be delivered by stacks, using a fork lift, or any movable vehicle with hoist capability. The stacks of wall panels can be placed near the walls needing the wall panels, e.g., the wall panel stacks can be distributed throughout the frame.

The frame can be prepared to accept the wall panels. For example, wooden beams can be coupled to the frame, and/or to the ceiling and floor to mark the positions at which the wall panels can be positioned. For example, the wooden beams can form a periphery of a plane so that the wall panels can be disposed at. A wall panel can be placed against a side of a wooden beam that is coupled to the frame, and against sides of wooden beams that are coupled to the ceiling and floor. A next wall panel can be placed adjacent to the first wall panel, against sides of wooden beams that are coupled to the ceiling and floor.

Operation 320 picks a wall panel, rotates the wall panel so that a shorter side facing the ground, and moves the wall panel to be installed next to a beam or to a previously installed wall panel, wherein the process is performed by a machine. The machine can be a lifting cart, e.g., a movable vehicle that can be operated manually by a worker, can be manually driven by a worker, or can be automatically driven, e.g., remotely operated, by a worker.

In some embodiments, after the wall panel is picked up, the wall panel can be tilted backward before rotating the wall panel. The tilting process can reduce the load on the picking equipment, since the rotation is performed at a tilting angle instead of in a vertical plane. The tilting process can further reduce the lifting height, since rotating at a tilting plane requires a lower lifting as compared to that at a vertical plane.

Operation 330 continues installing next wall panels. Operation 340 optionally installs installing a wall panel to a location between a wall panel and a beam of the frame by an operator. The last wall panel at a wall can be installed by an operator, since there may not be any room for the lifting cart to place the last wall panel into place.

In some embodiments, the present invention discloses a lifting cart and methods to use the lifting cart in assisting workers for installing precast wall panels. The lifting cart can include mechanisms for performing necessary movements, such as lifting, tilting, rotating, and moving the wall panels. The lifting cart can optionally include sensors for accurately accessing the situations for performing the movements. The lifting cart can include a controller programmed to automatically perform the operations, including using the sensors for automatically adjusting the movements so that the wall panels can be picked up and placed at proper locations. The lifting cart can be operated by a worker.

FIGS. 4A-4C illustrate a lifting cart configuration according to some embodiments. In FIG. 4A, a lifting cart can include a movable vehicle 460, having a set of wheels to allow the vehicle to move in planar directions, such as forward and backward 461 and rotating 462. The set of wheels can allow the lifting cart to transfer wall panels from a storage location to installed locations, together with aligning the wall panels into proper locations.

A handling mechanism 470 can be coupled to the vehicle 460 for handling the wall panel. The handling mechanism 470 can include a set of clamps 421, such as two clamps for clamping on a wall panel. The clamps 421 can have a clamping mechanism 420, which can move the jaws of the clamps away from each other or toward each other.

The clamp set 421 can be mounted on a linear movement mechanism, such as a linear guide, for moving 430 the clamp set along a linear direction. The linear movement mechanism can be mounted on a rotating mechanism 441, which can rotate the clamp set and the linear movement. Thus, the clamp set can move linearly in a direction determined by the rotation mechanism. For example, when the rotation mechanism is at rest, the clamp set can move up and down in a vertical direction. When the rotation mechanism rotates 90 degrees, the clamp set can move left and right in a horizontal direction.

FIG. 4B shows a process for forming a lifting cart. In operation 480, a plate handling mechanism can be formed. The plate handling mechanism can include a clamping mechanism, a linear moving mechanism, and a rotating mechanism. The linear moving mechanism can be coupled to the rotating mechanism in such a way to change the direction of the linear moving mechanism corresponded to the rotating angle.

In operation 481 (FIG. 4C), the plate handling mechanism is coupled to a movable vehicle. The movable vehicle can include a moving mechanism to move in planar directions.

Other mechanisms can be added, such as a titling mechanism and a vertical movement mechanism. The added vertical movement can allow moving the wall panel up and down, when the linear moving mechanism is rotated and thus cannot move the wall panel in the vertical direction.

Figure 5A:
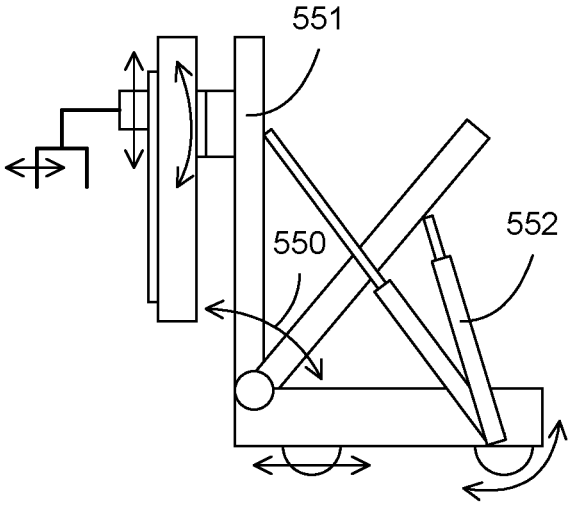
FIGS. 5A-5B illustrate lifting cart configurations according to some embodiments.
Figure 5B:
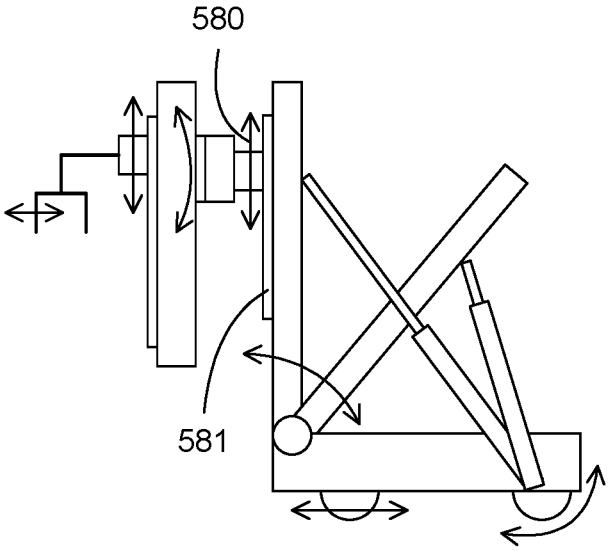

FIGS. 5A-5B illustrate lifting cart configurations according to some embodiments. In FIG. 5A, a tilting mechanism 550 can be added, for tilting the support 551 of the handling mechanism, e.g., the clamp set, the linear movement mechanism and the rotating mechanism. A cylinder 552 can be used for activating the tilting mechanism.

The tilting mechanism can reduce stress on the clamp set, and can allow ease of movement of the wall panel. For example, after lifting the wall panel to clear the ground, the wall panel can be tilted, before rotating. The wall panel can stay in the tilted configuration during the movement to the installed location. The wall panel can be re-positioned as an upright wall panel when the wall panel has reached the destination.

In FIG. 5B, an additional vertical movement mechanism 581 can be added to allow the wall panel to move in a vertical direction 580. Further, a tilting mechanism can be added.

FIGS. 6A-6H illustrate movements of a lifting cart according to some embodiments. The movements can be configured to re-position a wall panel 610 from a horizontal position to a vertical position. The horizontal position can be a position in which the wall panel has an edge with a longer side on the ground. The horizontal position can be a position for multiple wall panels to be stacked together without any load on the wall panels, e.g., the wall panels can be placed side by side, with the surfaces of the wall panels touching each other. The vertical position can be a final position for the wall panel, e.g., the position of the wall panel to form a wall of the building between the frame beams.

FIGS. 6A-6E and FIG. 6G show a front view and a side view of the lifting cart together with a wall panel. FIG. 6F and FIG. 6H show only a front view.

Figure 6A:
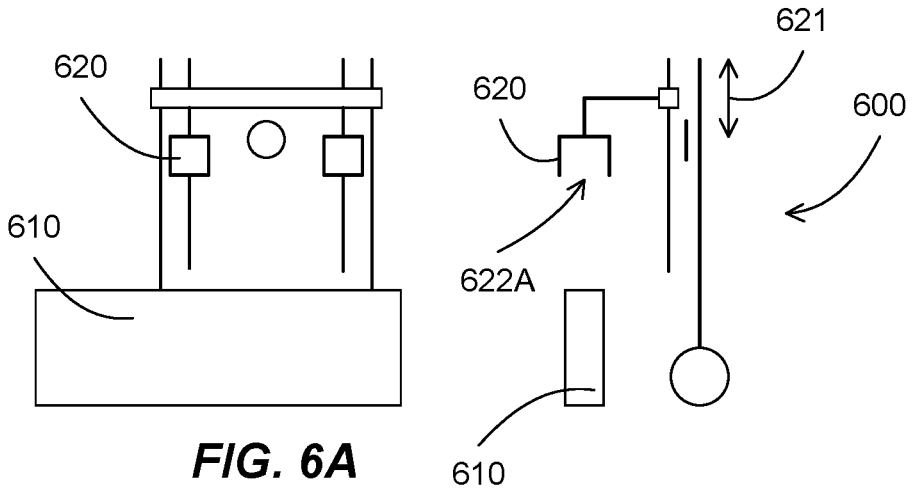
FIGS. 6A-6H illustrate movements of a lifting cart according to some embodiments.

In FIG. 6A, a lifting cart 600 can include a clamp 620 that can move 621 up and down, for example, by a hydraulic cylinder or by a motorized mechanism. The clamp 620 can include a mechanism for opening the jaws, for example, by a hydraulic cylinder or by a motorized mechanism. The clamp jaws can be open 622A, e.g., the space between the jaws can be enlarged to be larger than the thickness of the wall panel.

The lifting cart can include a moving mechanism, such as wheels for manually operations, e.g., pushing for going forward, pulling for going backward, or rotating for turning, by a worker. The moving mechanism can include motorized wheels, such as an electric motor or an engine to operate the wheels. A worker then can drive the lifting cart, instead of manually operating the lifting cart by pushing, pulling or rotating the cart. The moving mechanism can be controlled by a controller, to allow a worker to remotely operate the lifting cart. For example, by standing next to the wall panel stack, the worker can control the lifting cart to approach the wall panel stack in appropriate directions and positions.

The lifting cart can move to face the wall panel, e.g., facing the large surface of the wall panel, such as perpendicular to the wall panel. The clamp can be position to be parallel with the wall panel, in order to clamp on the top edge of the wall panel.

Figure 6B:
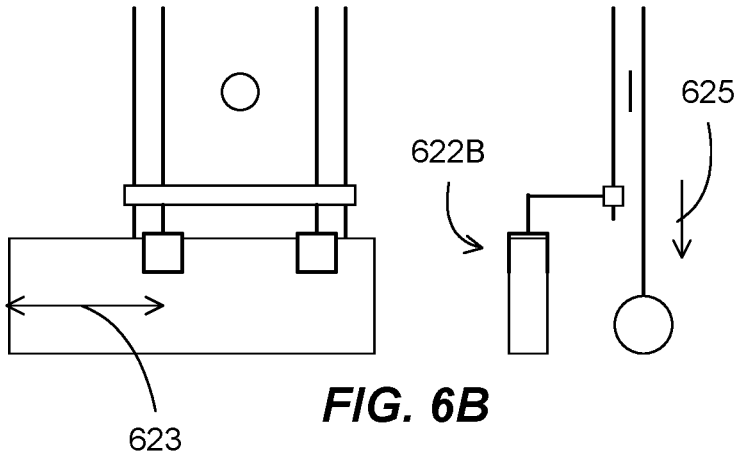

In FIG. 6B, after the lifting cart is properly position before the wall panel, the clamp 620 can move down 625 for gripping on the wall panel. The clamp can clamp on a particular location on the wall panel that can be determined so that when the wall panel is rotated, the edge of the wall panel will be in a vicinity of the ground. The location can be dependent on the rotation center of the clamp, together with the distance 623 from the short edge of the wall panel to the clamp.

In some embodiments, the lifting cart can include a hard stop, such as a ruler from the clamp. The lifting cart can move sideway after moving forward to face the wall panel. The sideway movement can allow the clamp to clamp on the proper location, e.g., at a distance 623 from the to-be-touching-the ground edge of the wall panel, e.g., the left edge if the clamp can rotate counter clockwise, and the right edge if the clamp can rotate clockwise. The lifting cart can include a sideway movement mechanism, in addition to a forward/backward movement mechanism.

In some embodiments, the lifting cart can include a sensor to determine an edge of the wall panel, so that the clamp can be the distance 623 from an edge of the wall panel. If the distance is not correct, the lifting cart can adjust its position, for example, by backtracking and then re-forwarding, or by a sideway movement.

In some embodiments, the lifting can include a parallel movement mechanism, e.g., to move the wall panel along the direction of the long side. Thus if the wall panel does not touch the ground after rotated, the parallel movement mechanism can be activated to position the wall panel on the ground.

In some embodiments, the parallel movement mechanism can be incorporated with another movement mechanism, such as the tilting mechanism. For example, the tilting mechanism can tilt the wall panel, e.g., turning the all panel from a position perpendicular to the ground to a position making an angle less than 90 degrees with the ground. The tilting mechanism can be limited at the perpendicular position, and any further movement of the tilting mechanism can lower the wall panel, For example, the tilting mechanism can include a four-bar linkage coupled to a tiltable plane. When the tiltable plane is perpendicular, the four bar linkage is activated, moving the wall panel downward while still maintaining the perpendicular direction.

Figure 6C:
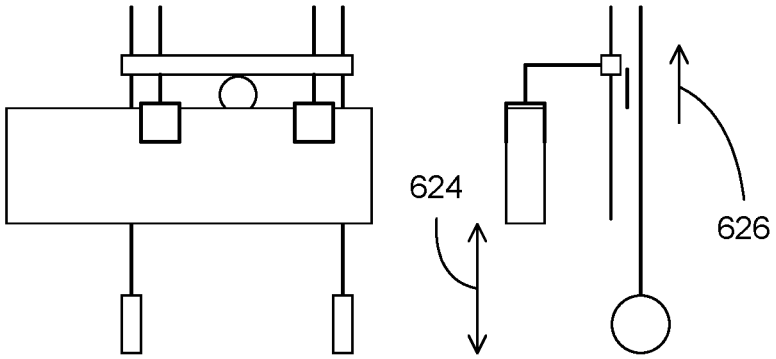

In FIG. 6C, after clamping on the wall panel, the clamp can be lifted up 626, for example, by the same movement mechanism that moves the clamp down. The wall panel can be lifted up from the ground to a distance 624 that prevents the wall panel from touching the ground when the clamp rotates, e.g., when the wall panel is rotated so that the short edge will face the ground.

Figure 6D:
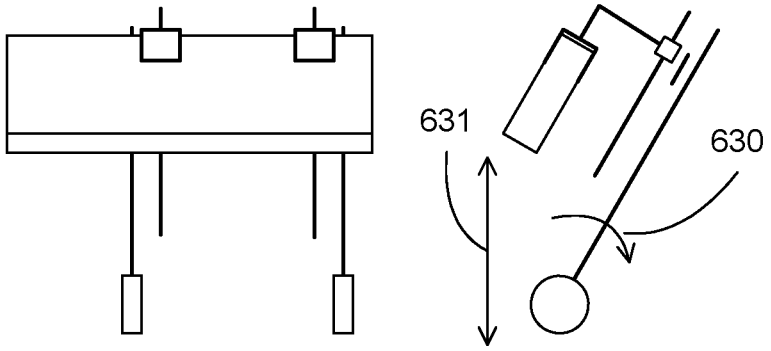

In FIG. 6D, the lifting cart can be tilted 630, for tilting the wall panel. The lifting cart can tilt an angle 90 degrees or less (e.g., 90 degree tile can make the wall panel parallel with the ground), such as 60 degrees or less, 45 degrees or less, or 30 degrees or less. For example, the wall panel can be tilted an angle between 30 and 60 degrees, or between 40 and 50 degrees, such as 40 or 45 degrees. A combination of lifting and tilting can make the bottom edge of the wall panel separate a distance 631 from the ground. The distance 631 can be so that when the wall panel is rotated, the edge of the wall panel will be in a vicinity of the ground when the lifting cart is tilted back, e.g., so that the wall panel can be perpendicular to the ground.

Figure 6E:
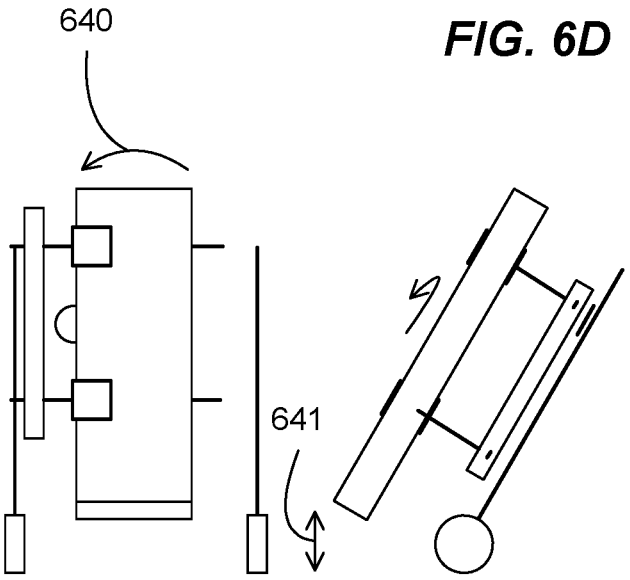
Figure 6F:
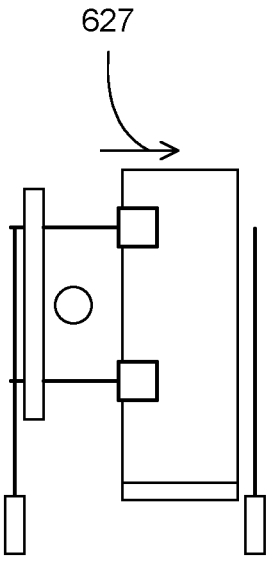

In FIG. 6E, the clamp, and the wall panel, can be rotated 640. During the rotation process, the wall panel can be separated a distance 641 from the ground, e.g., the wall panel does not contact the ground during the rotation process. Due to the tilting angle of the wall panel, when the wall panel returns to the vertical position, the bottom edge of the wall panel can be touching, or at a close vicinity of the ground.

In FIG. 6F, the wall panel can be optionally move 627 to a side, e.g., the lifting mechanism of the claim can operate as to lower the clamp. But since the clamp has been rotated 90 degrees, a lower operation of the clamp mechanism can result in a sideway movement. This operation can be optional, which can allow the clamp to retract, releasing the wall panel. Alternatively, the lifting cart can move sideway, by using a sideway movement mechanism discussed above, to release the wall panel.

Figure 6G:
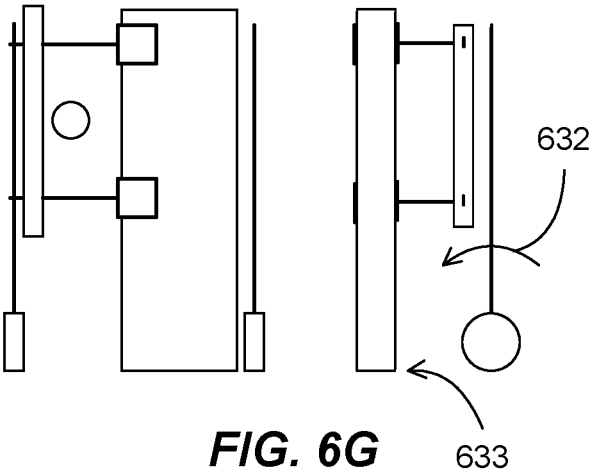
Figure 6H:
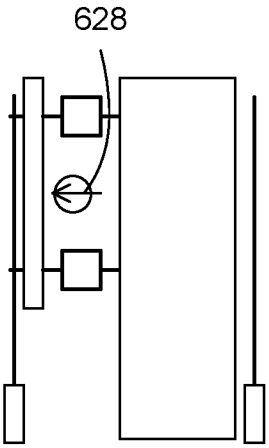

In FIG. 6G, the lifting cart can be un-tilted 632, e.g., reversing the tilting operation to return the wall panel to the upright, e.g., perpendicular, position. The edge of the wall panel can be touching the ground or close to the ground, e.g., the clamp can clamp the wall panel at an appropriate location to allow the wall panel, after rotating 90 degrees, can rest on the ground. Alternatively, the wall panel can be separate a little from the ground, for example, leaving a gap for a cement coating at a bottom side of the wall panel.

Alternatively, the titling mechanism can include a four bar linkage, which can allow the wall panel to move parallelly forward and downward when the titling mechanism continues its tilting operation.

In FIG. 6H, the clamp can be released and then retracted, leaving the wall panel free standing or coupled to other wall panels to form the wall. The lifting cart can be retracted from the free-standing wall panel. This operation can be optional, which can occur if the clamp has been extended to move the wall panel sideway.

Alternatively, after the clamp is released, the lifting cart can move sideway to move the released clamp from the wall panel. The lifting cart can have the sideway movement mechanism to perform the sideway movement, as discussed above.

In some embodiments, the operations can occur sequentially, concurrent, or a combination of sequential and concurrent. For example, the wall panel can be lifted up. When the wall panel is lifted more than 50% of the total lifting distance, such as more than 60%, 70%, 80%, or 90%, the wall panel can be started tilting. When the wall panel is tilting, the wall panel can be rotated. Similar to the concurrent operations of lifting and tilting, the concurrent operations of tilting and rotating can occur completely concurrent, or can happen after the wall panel has been tilted a percent of the tilting operation.

In some embodiments, the operations can occur in different orders. For example, the wall panel can be moved sideway before rotating.

Figure 7A:
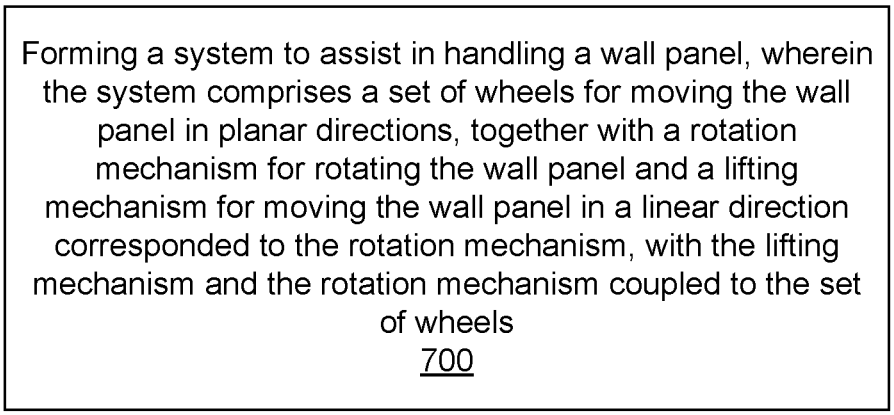
FIGS. 7A-7B illustrate flow charts for a lifting cart according to some embodiments.
Figure 7B:
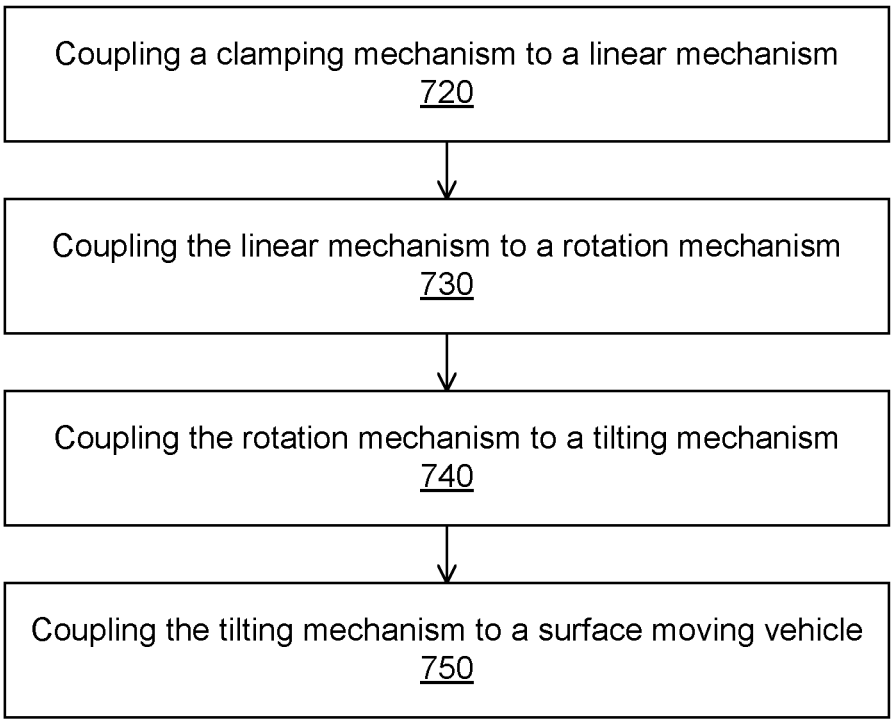

FIGS. 7A-7B illustrate flow charts for a lifting cart according to some embodiments. In FIG. 7A, operation 700 forms a system to assist in handling a wall panel. The system can include a set of wheels for moving the wall panel in planar directions, together with a rotation mechanism for rotating the wall panel and a lifting mechanism for moving the wall panel in a linear direction corresponded to the rotation mechanism, with the lifting mechanism and the rotation mechanism coupled to the set of wheels.

In FIG. 7B, operation 720 couples a clamping mechanism to a linear mechanism. The clamping mechanism can be configured to hold and support a wall panel. The linear mechanism can be configured to move the clamping mechanism, together with the wall panel that the clamping mechanism supports, in a straight line, such as a vertical direction.

Operation 730 couples the linear mechanism to a rotation mechanism. The rotation mechanism can be configured to rotate the linear mechanism (and the clamping mechanism and the wall panel, if the clamping mechanism clamps in a wall panel). Since the rotation mechanism is coupled to the linear mechanism, the clamping mechanism can move along a line having a movement direction determined by the rotation mechanism. For example, if the rotation mechanism is at a base position, the linear mechanism can move along a vertical direction. When the rotation mechanism rotates 90 degrees, the linear mechanism can move along a horizontal direction.

Operation 740 couples the rotation mechanism to a tilting mechanism. The tilting mechanism can be configured to tilt the rotation mechanism (and the linear mechanism, the clamping mechanism and the wall panel, if the clamping mechanism clamps in a wall panel).

Operation 750 couples the tilting mechanism to a surface moving vehicle.

Figure 8:
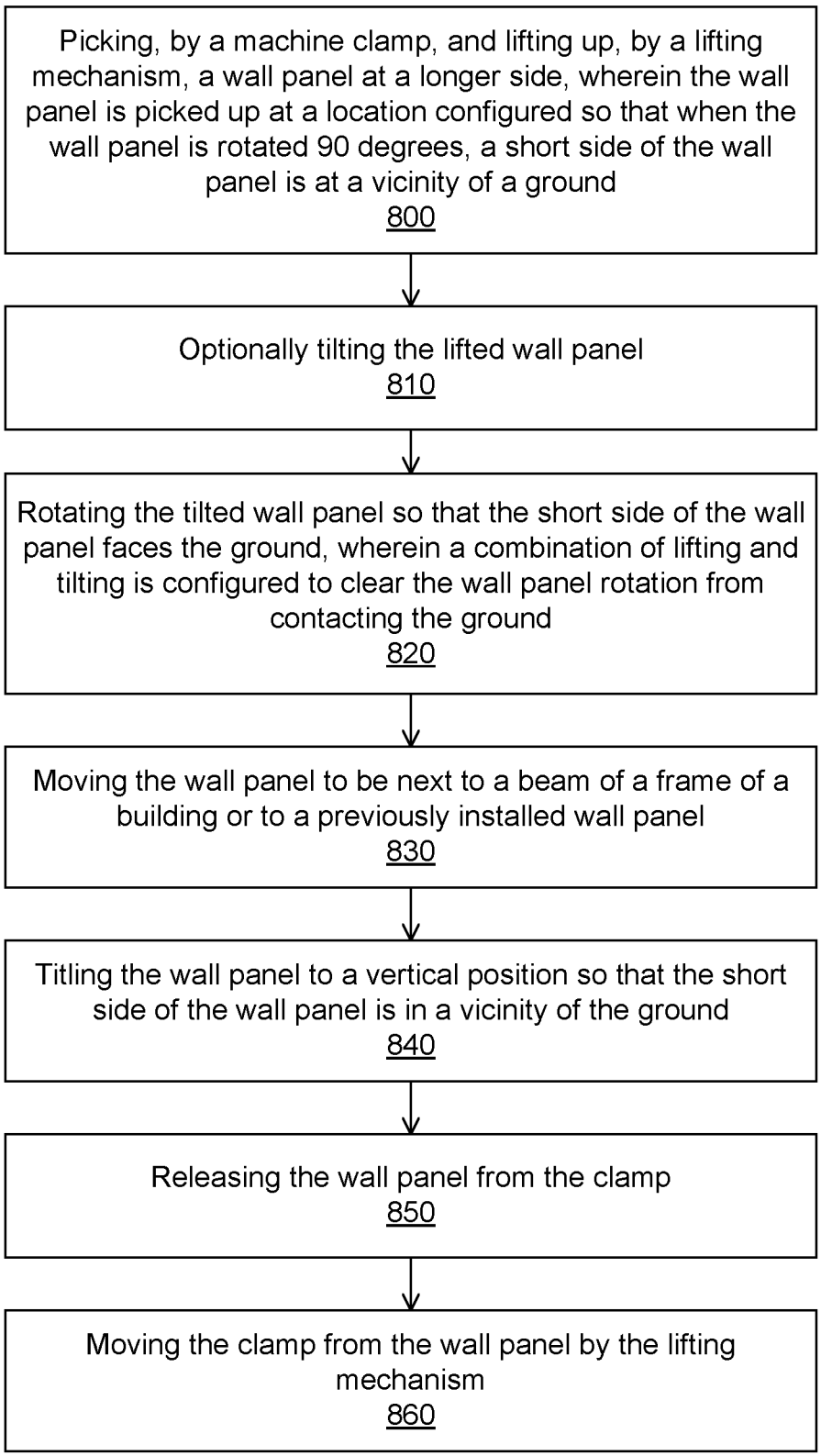
FIG. 8 illustrates a flow chart for operating a lifting cart according to some embodiments.

FIG. 8 illustrates a flow chart for operating a lifting cart according to some embodiments. In FIG. 8, operation 800 picks, by a machine clamp, and lifting up, by a lifting mechanism, a wall panel at a longer side, wherein the wall panel is picked up at a location configured so that when the wall panel is rotated around 90 degrees, a short side of the wall panel is at a vicinity of a ground. Operation 810 optionally tilts the lifted wall panel. Operation 820 rotates the tilted wall panel so that the short side of the wall panel faces the ground, wherein a combination of lifting and tilting is configured to clear the wall panel rotation from contacting the ground. Operation 830 moves the wall panel to be next to a beam of a frame of a building or to a previously installed wall panel. Operation 840 tilts the wall panel to a vertical position so that the short side of the wall panel is in a vicinity of the ground. Operation 850 tilts releases the wall panel from the clamp. Operation 860 moves the clamp from the wall panel by the lifting mechanism In some embodiments, the lifting cart can be configured to move a vertical panel up and down, and letting the cart moves the panel sideways.

Figure 9:
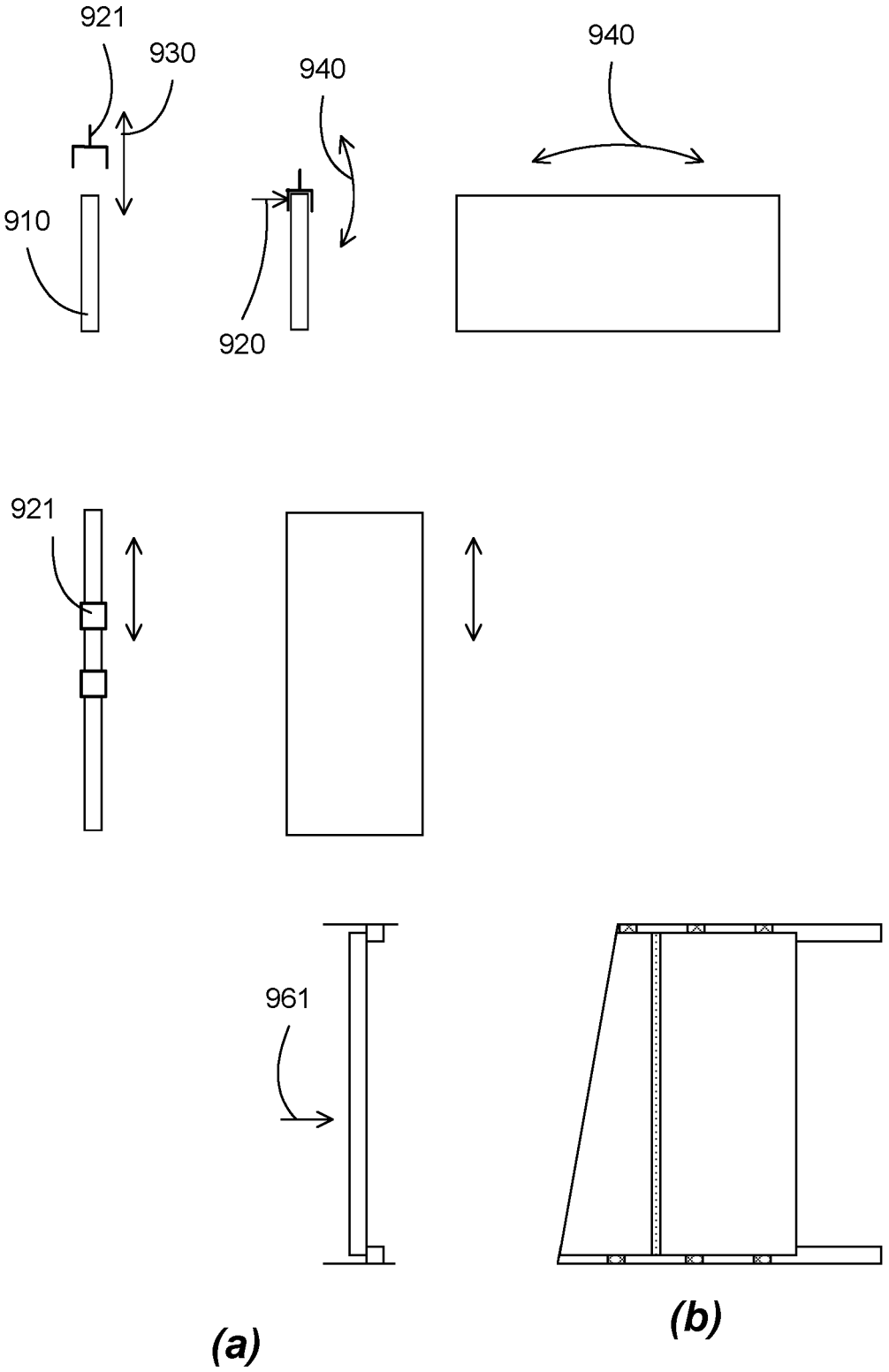
FIG. 9 illustrates a process for installing a wall panel according to some embodiments.

FIG. 9 illustrates a process for installing a wall panel according to some embodiments. FIG. 9(*a*) show a side view and FIG. 9(*b*) show another side view of a process for installing a wall panel. A wall panel 910 can be stacked side by side, e.g., in a horizontal direction facing the ground. A clamp 921, from a handling mechanism on a lifting cart, can be lowered 930 on a wall panel. The clamp can be tightened, e.g., the jaws of the clamp can move 920 toward each other to secure on the wall panel. The handling mechanism can rotate 940 the wall panel, so that the width of the wall panel facing the ground. The handling mechanism can lift the wall panel up, to clear the ground before rotating.

The handling mechanism can also tilt the wall panel backward, to reduce the load on the clamp. For example, after tilting, the wall panel can rest on a set of wheels, which can allow rotating the wall panel with minimum force on the clamp.

The lifting cart can move 961 the wall panel into the installed position, e.g., against edge stop bars 940 mounted on the frame. The handling mechanism can move the wall panel up or down, for example, to align the wall panel with the space for the wall panel to be installed to. Glue, insulation foam, and cement coating can be used to seal any gaps between the wall panels and the frame.

In some embodiments, the present invention discloses a lifting cart and methods to use the lifting cart in assisting workers for installing precast wall panels. The lifting cart can include mechanisms for performing necessary movements, such as lifting, tilting, rotating, and moving the wall panels. The lifting cart can optionally include sensors for accurately accessing the situations for performing the movements. The lifting cart can include a controller programmed to automatically perform the operations, including using the sensors for automatically adjusting the movements so that the wall panels can be picked up and placed at proper locations. The lifting cart can be operated by a worker.

FIGS. 10A-10B illustrate a lifting cart configuration according to some embodiments. In FIG. 10A, a lifting cart can include a movable vehicle 1060, having a set of wheels to allow the vehicle to move in planar directions, such as forward and backward 1061 and rotating 1062. The set of wheels can allow the lifting cart to transfer wall panels from a storage location to installed locations, together with aligning the wall panels into proper locations.

A handling mechanism 1070 can be coupled to the vehicle 1060 for handling the wall panel. The handling mechanism 1070 can include a set of clamps 1021, such as two clamps for clamping on a wall panel. The clamps 1021 can have a clamping mechanism 1020, which can move the jaws of the clamps away from each other or toward each other.

The clamp set 1021 can be mounted on a rotating mechanism 1041, which can rotate the clamp set. The rotating mechanism and the clamp set can be mounted on a linear movement mechanism, such as a linear guide, for moving 1030 the clamp set along a linear direction. The linear movement mechanism can be mounted on a platform 1051 coupled to the vehicle 1060. Thus, the clamp set can move linearly in a vertical direction, regardless of the rotating mechanism.

The platform 1051 can be tilted 1050, e.g., having a hinge for rotating in a direction perpendicular to the rotation plane defined by the rotating mechanism 1040. An actuating element 1052, such as a hydraulic cylinder or an actuator, can be used to tilt the platform 1051.

FIG. 10B shows a process for forming a lifting cart. In operation 1080, a plate handling mechanism can be formed. The plate handling mechanism can include a clamping mechanism, a linear moving mechanism, a rotating mechanism, and an optional tilting mechanism. The linear moving mechanism can be directly coupled to the rotating mechanism in such a way as not to change the direction of the linear moving mechanism regardless of the rotating angle.

In operation 1081, the plate handling mechanism is coupled to a movable vehicle. The movable vehicle can include a moving mechanism to move in planar directions.

Figure 11A:
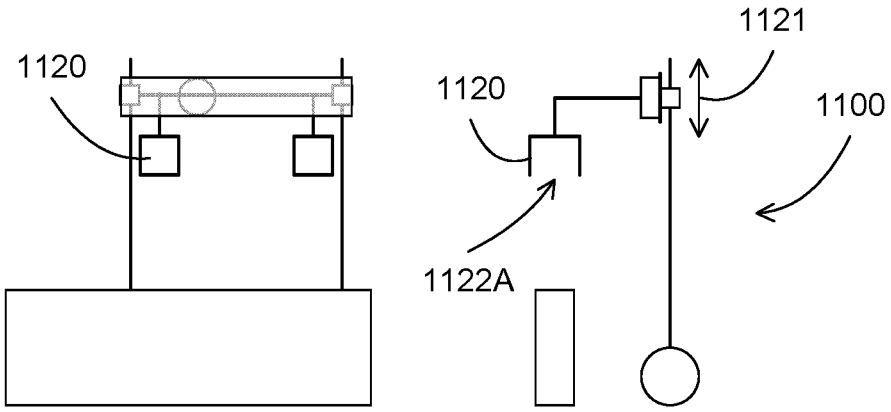
FIGS. 11A-11G illustrate movements of a lifting cart according to some embodiments.
Figure 11B:
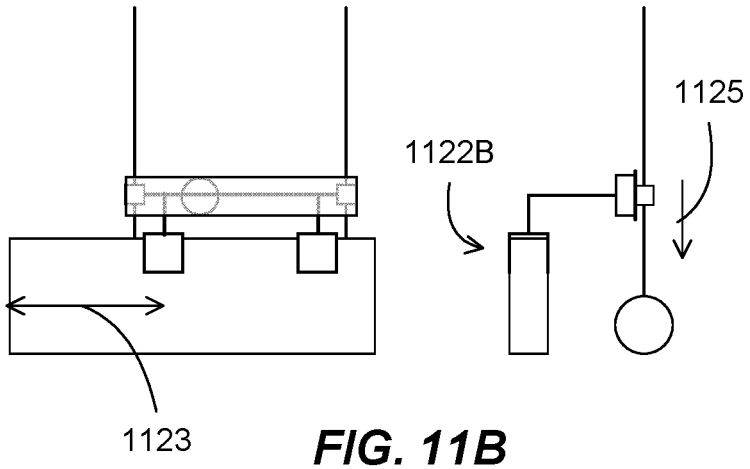
Figure 11C:
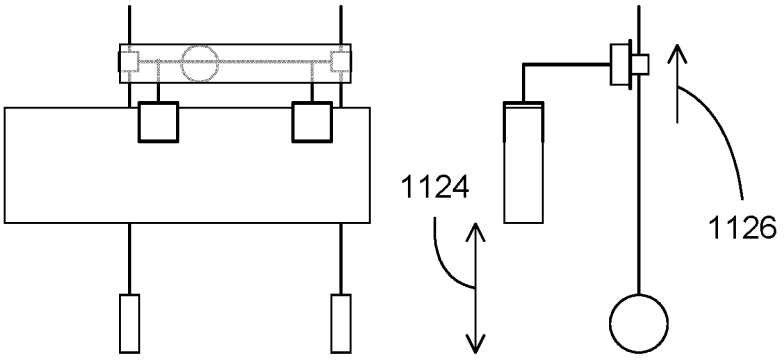
Figure 11D:
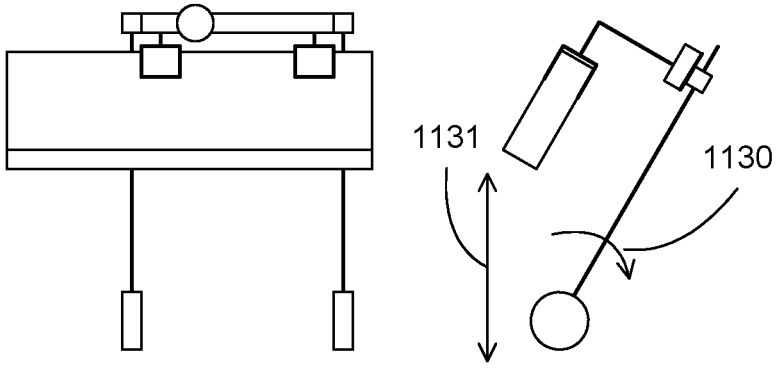
Figure 11E:
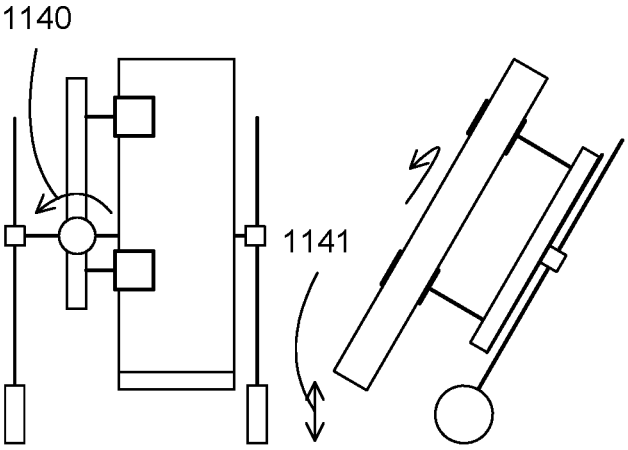
Figure 11F:
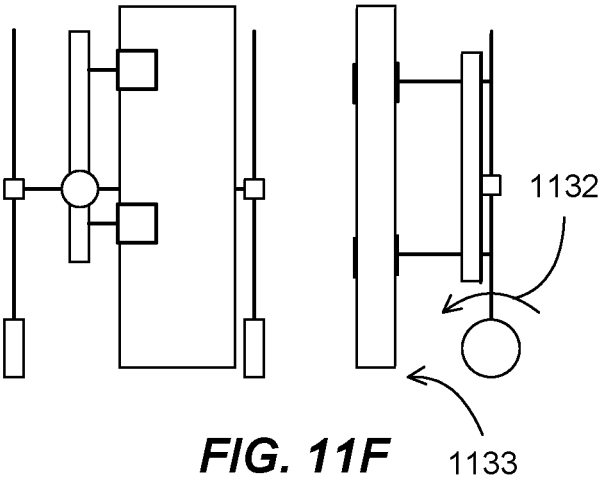
Figure 11G:
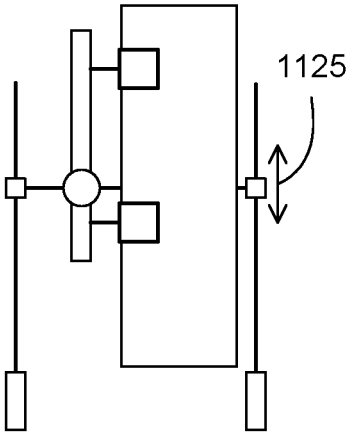

FIGS. 11A-11G illustrate movements of a lifting cart according to some embodiments. FIGS. 11A-11F show a front view and a side view of the lifting cart together with a wall panel. FIG. 11G shows only a front view.

In FIG. 11A, a lifting cart 1100 can include a clamp 1120 that can move 1121 up and down, for example, by a hydraulic cylinder or by a motorized mechanism. The clamp 1120 can include a mechanism for opening the jaws, for example, by a hydraulic cylinder or by a motorized mechanism. The clamp jaws can be open 1122A, e.g., the space between the jaws can be enlarged to be larger than the thickness of the wall panel.

In FIG. 11B, after the lifting cart is properly position before the wall panel, the clamp 1120 can move down 1125 for gripping on the wall panel. The clamp can clamp on a particular location on the wall panel that can be determined so that when the wall panel is rotated, the edge of the wall panel will be in a vicinity of the ground. The location can be dependent on the rotation center of the clamp, together with the distance 1123 from the short edge of the wall panel to the clamp.

In some embodiments, the lifting cart can include a hard stop, such as a ruler from the clamp. The lifting cart can move sideway after moving forward to face the wall panel. The sideway movement can allow the clamp to clamp on the proper location, e.g., at a distance 1123 from the to-be-touching-the ground edge of the wall panel, e.g., the left edge if the clamp can rotate counter clockwise, and the right edge if the clamp can rotate clockwise. The lifting cart can include a sideway movement mechanism, in addition to a forward/backward movement mechanism.

In some embodiments, the lifting cart can include a sensor to determine an edge of the wall panel, so that the clamp can be the distance 1123 from an edge of the wall panel. If the distance is not correct, the lifting cart can adjust its position, for example, by backtracking and then re-forwarding, or by a sideway movement.

In FIG. 11C, after clamping on the wall panel, the clamp can be lifted up 1126, for example, by the same movement mechanism that moves the clamp down. The wall panel can be lifted up from the ground to a distance 1124 that prevents the wall panel from touching the ground when the clamp rotates, e.g., when the wall panel is rotated so that the short edge will face the ground.

In FIG. 11D, the lifting cart can be tilted 1130, for tilting the wall panel. The lifting cart can tilt an angle 90 degrees or less (e.g., 90 degree tile can make the wall panel parallel with the ground), such as 110 degrees or less, 45 degrees or less, or 30 degrees or less. For example, the wall panel can be tilted an angle between 30 and 110 degrees, or between 40 and 50 degrees, such as 40 or 45 degrees. A combination of lifting and tilting can make the bottom edge of the wall panel separate a distance 1131 from the ground. The distance 1131 can be so that when the wall panel is rotated, the edge of the wall panel will be in a vicinity of the ground when the lifting cart is tilted back, e.g., so that the wall panel can be perpendicular to the ground.

In FIG. 11E, the clamp, and the wall panel, can be rotated 1140. During the rotation process, the wall panel can be separated a distance 1141 from the ground, e.g., the wall panel does not contact the ground during the rotation process. Due to the tilting angle of the wall panel, when the wall panel returns to the vertical position, the bottom edge of the wall panel can be touching, or at a close vicinity of the ground.

In FIG. 11F, the lifting cart can be un-tilted 1132, e.g., reversing the tilting operation to return the wall panel to the upright, e.g., perpendicular, position.

In FIG. 11G, the wall panel can be lifted up or down using the same lifting mechanism as mentioned above.

In some embodiments, the operations can occur in different orders. For example, the wall panel can be moved sideway before rotating.

Figure 12A:
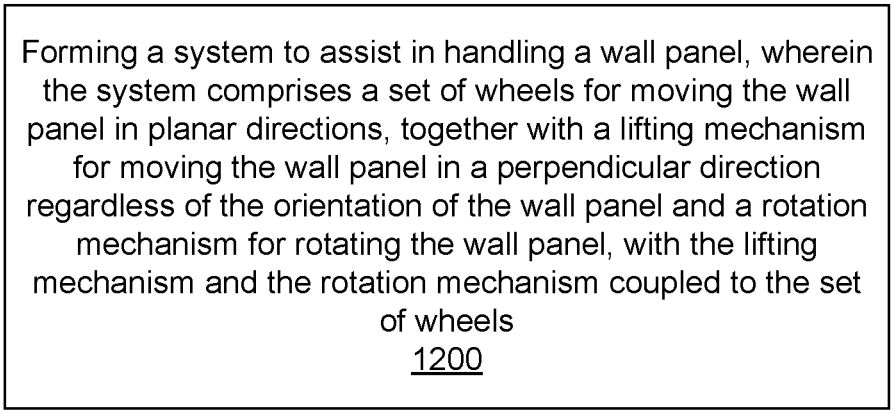
FIGS. 12A-12B illustrate flow charts for a lifting cart according to some embodiments.
Figure 12B:
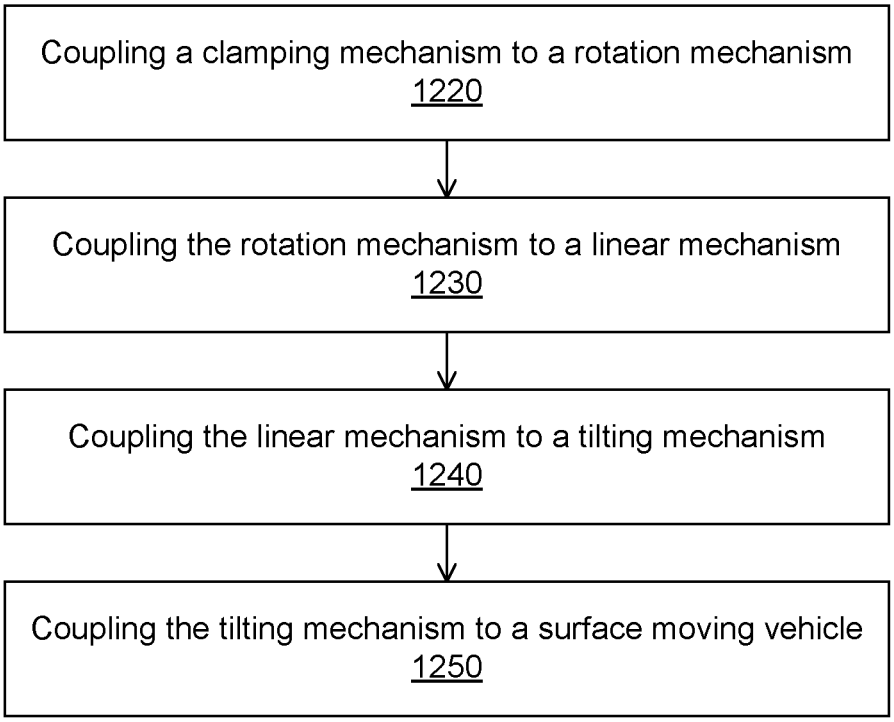

FIGS. 12A-12B illustrate flow charts for a lifting cart according to some embodiments. In FIG. 12A, operation 1200 forms a system to assist in handling a wall panel. The system can include a set of wheels for moving the wall panel in planar directions, together with a lifting mechanism for moving the wall panel in a perpendicular direction regardless of the orientation of the wall panel and a rotation mechanism for rotating the wall panel, with the lifting mechanism and the rotation mechanism coupled to the set of wheels.

In FIG. 12B, operation 1220 couples a clamping mechanism to a rotation mechanism. The rotation mechanism can be configured to rotate the clamping mechanism and the wall panel, if the clamping mechanism clamps in a wall panel.

Operation 1230 couples the rotation mechanism to a linear mechanism. The linear mechanism can move the rotation mechanism and the clamping mechanism in a vertical direction. The rotation mechanism can be coupled to the linear mechanism in such a way so that the clamping mechanism moves in a vertical direction, regardless of the rotating angle of the rotation mechanism.

Operation 1240 couples the linear mechanism to a tilting mechanism. The tilting mechanism can be configured to tilt the linear mechanism (and the rotation mechanism, the clamping mechanism and the wall panel, if the clamping mechanism clamps in a wall panel).

Operation 1250 couples the tilting mechanism to a surface moving vehicle.

Figure 13:
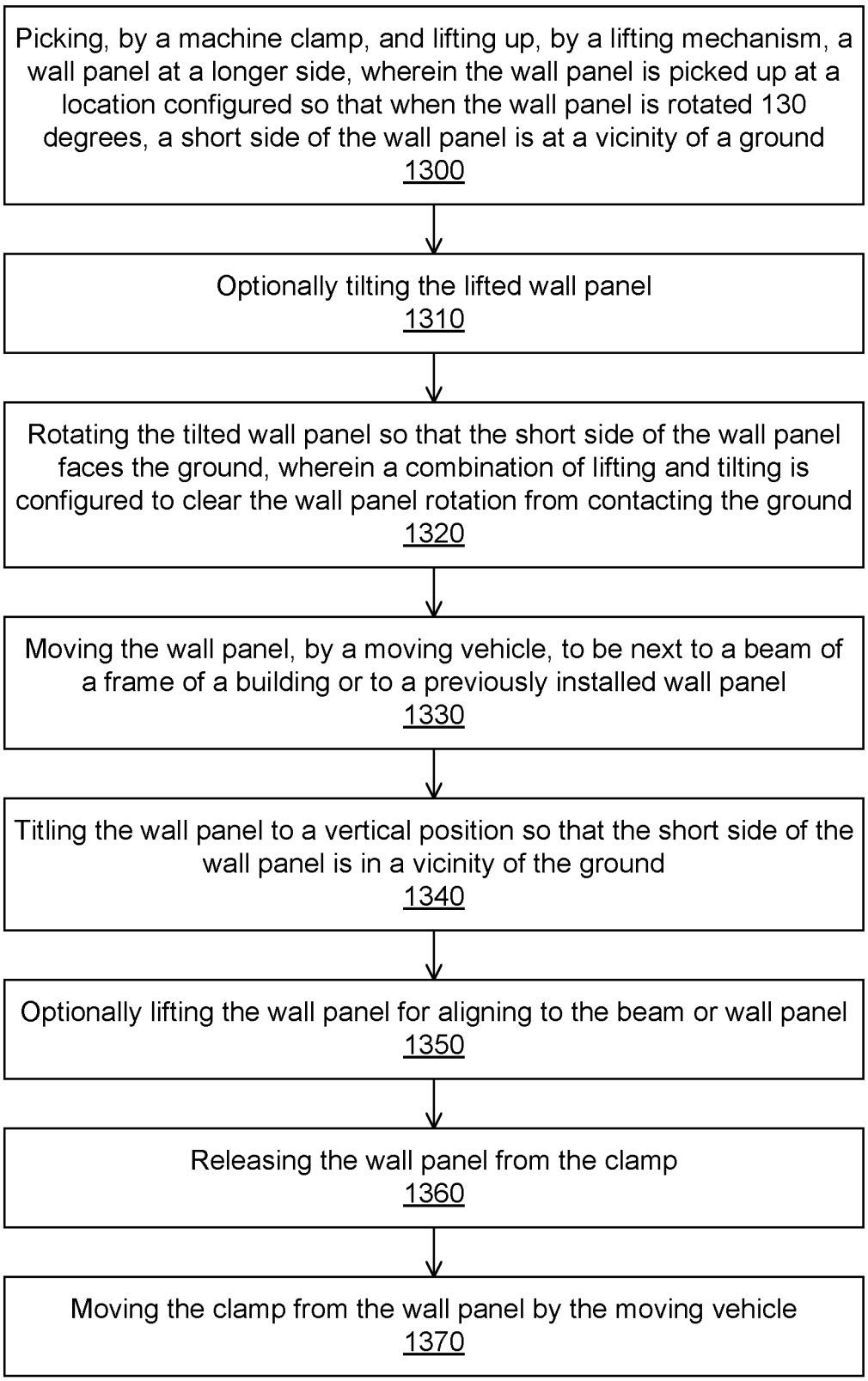
FIG. 13 illustrates a flow chart for operating a lifting cart according to some embodiments.

FIG. 13 illustrates a flow chart for operating a lifting cart according to some embodiments. In FIG. 13, operation 1300 picks, by a machine clamp, and lifting up, by a lifting mechanism, a wall panel at a longer side, wherein the wall panel is picked up at a location configured so that when the wall panel is rotated 90 degrees, a short side of the wall panel is at a vicinity of a ground. Operation 1310 optionally tilts the lifted wall panel. Operation 1320 rotates the tilted wall panel so that the short side of the wall panel faces the ground, wherein a combination of lifting and tilting is configured to clear the wall panel rotation from contacting the ground. Operation 1330 moves the wall panel to be next to a beam of a frame of a building or to a previously installed wall panel. Operation 1340 tilts the wall panel to a vertical position so that the short side of the wall panel is in a vicinity of the ground. Operation 1350 optionally lifts the wall panel for aligning to the beam or wall panel. Operation 1360 releases the wall panel from the clamp. Operation 1370 moves the clamp from the wall panel by the moving vehicle.

In some embodiments, the lifting cart can move in all directions. For example, the lifting cart can have steering wheels to allow the lifting cart to turn. Alternatively, the lifting cart can have two independently-rotating wheels, together with one or more dependent wheels. The two independently-rotating wheels, when rotating in a same direction, can allow the lifting cart to move forward or backward. The two independently-rotating wheels, when rotating in different directions, can allow the lifting cart to turn at a tighter radius, as compared to the steering wheels. Alternatively, the lifting cart can have omni-directional wheels or omni-capable wheels such as Liddiard wheels (US patents 2012/0181846 and 2016/0023511, hereby incorporated by reference in their entirety), which can allow the lifting cart to move in all directions, especially forward/backward and sideway. Alternatively, the lifting cart can have a forward/backward movement mechanism, together with a sideway movement mechanism.

Figure 14A:
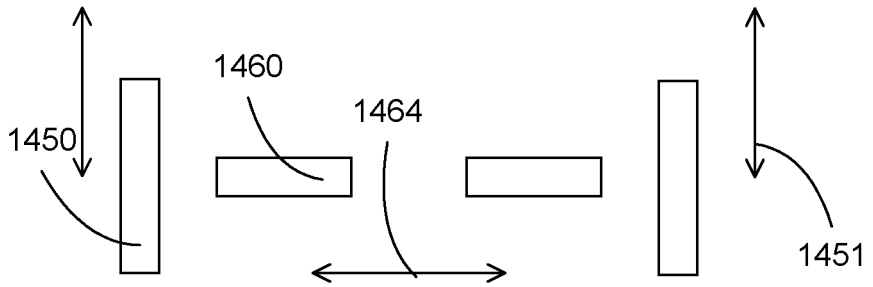
FIGS. 14A-14B illustrate a configuration of movement mechanisms according to some embodiments.
Figure 14B:
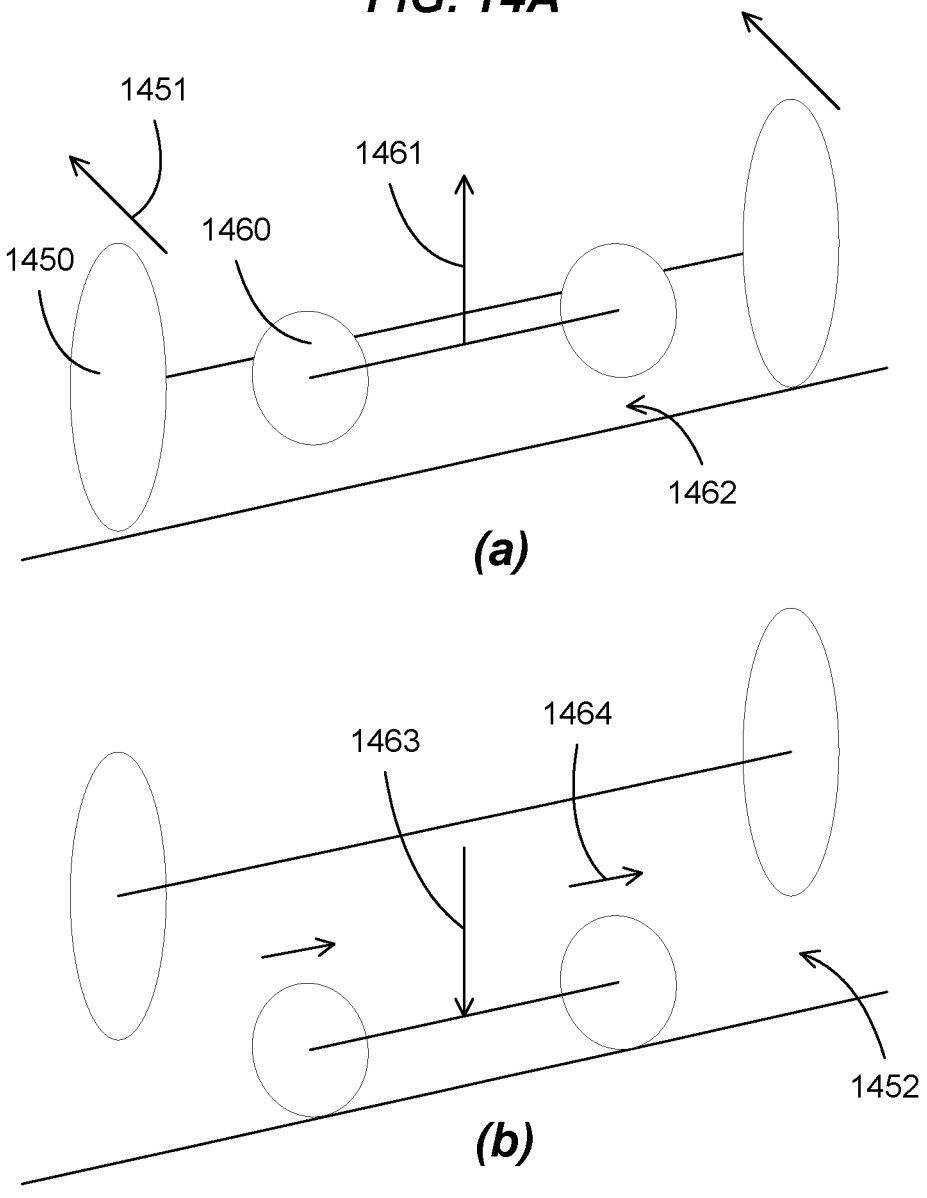

FIGS. 14A-14B illustrate a configuration of movement mechanisms according to some embodiments. A lifting cart can have 2 sets of wheels, one set for moving forward and backward, and one set for moving sideway. Normally, the lifting cart can have activated the set of wheels for moving forward and backward. A mechanism can be included to activate or to deactivate the set of sideway wheels. When the set of sideway wheels is activated, the set of forward/backward wheels can be automatically deactivated. FIG. 14A shows a top view. FIG. 14B show a perspective view, in which FIG. 14B(a) shows the deactivation of the set of sideway wheels, and FIG. 14B(b) shows the activation of the set of sideway wheels.

In FIG. 14A, a lifting cart can have a set of forward and backward wheels 1450, and a set of sideway wheels 1460. The set of forward and backward wheels can be configured to allow the lifting cart to move forward 1451 and backward, e.g., the wheels can be positioned facing forward. The set of sideway wheels can be configured to allow the lifting cart to move sideway 1464, e.g., the wheels can be positioned facing sideway, which can be perpendicular to the forward direction.

In FIG. 14B(a), the mechanism to activate or deactivate the sideway wheel can be deactivated 1461, lifting the sideway wheels off the ground, e.g., the sideway wheels can be a distance 1462 from the ground. The forward and backward wheels become the operating wheels, which can allow the lifting cart to move forward and backward.

In FIG. 14B(b), the mechanism to activate or deactivate the sideway wheel can be activated 1463, pushing the sideway wheels toward the ground. The sideway wheels can go further downward, lifting up the forward and backward wheels off the ground, e.g., the forward and backward wheels can be a distance 1452 from the ground. The sideway wheels become the operating wheels, which can allow the lifting cart to move sideway.

The lifting cart can include other wheels. For example, the lifting cart can include a first set of wheels for moving in all planar directions, including a forward/backward direction. The lifting cart can move in all directions to move the wall panel from a stacked location to an installed location. The lifting cart can be maneuvered to approach the to-be-installed wall in a perpendicular direction, e.g., the forward/backward direction. Thus the wall panel can be placed at the proper location at the to-be-installed wall, e.g., parallel with the wall.

The lifting cart can include a second set of wheels for moving in a direction perpendicular to the forward/backward direction. After placing the wall panel at the to-be-installed wall location, the lifting cart can move parallel to the wall, e.g., in a direction perpendicular to the forward/backward direction to leave the wall panel in place without disturbing the wall panel.

Figure 15A:
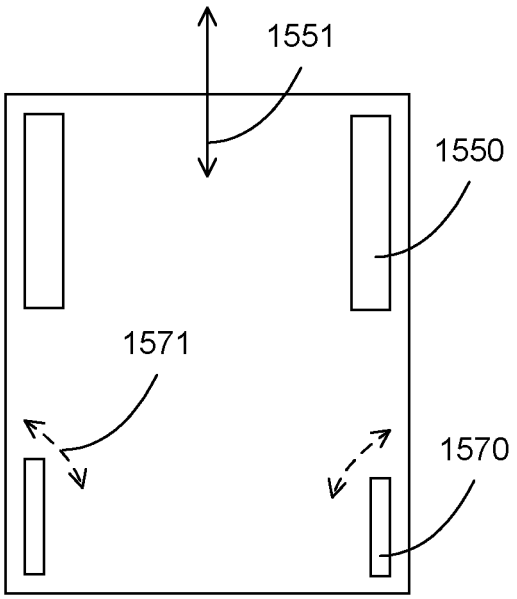
FIGS. 15A-15D illustrate configurations for a lifting cart according to some embodiments.

FIGS. 15A-15D illustrate configurations for a lifting cart according to some embodiments. FIG. 15A shows a configuration for a lifting cart with a set of wheels that can allow the lifting cart to move in planar directions. The lifting cart can have two wheels 1550 positioned in a forward/backward direction 1551. The two wheel configuration can allow the cart to move in a direction perpendicular to a wall, at least in a short distance.

The lifting cart can have two back wheels 1570, which can rotate 1571. With the four wheel combination, the cart can move in all planar directions.

Figure 15B:
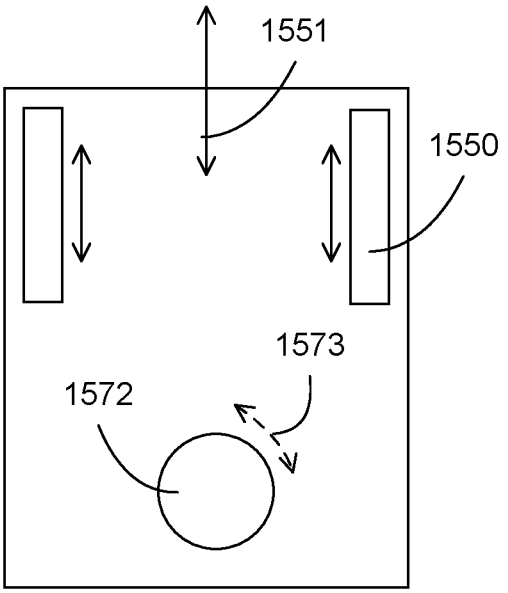

FIG. 15B shows another configuration for a lifting cart with a set of wheels that can allow the lifting cart to move in planar directions. The lifting cart can have two wheels positioned in a forward/backward direction. The lifting cart can have a rotatable back wheel 1572, which can rotate 1573. With the three wheel combination, the cart can move in all planar directions.

Figure 15C:
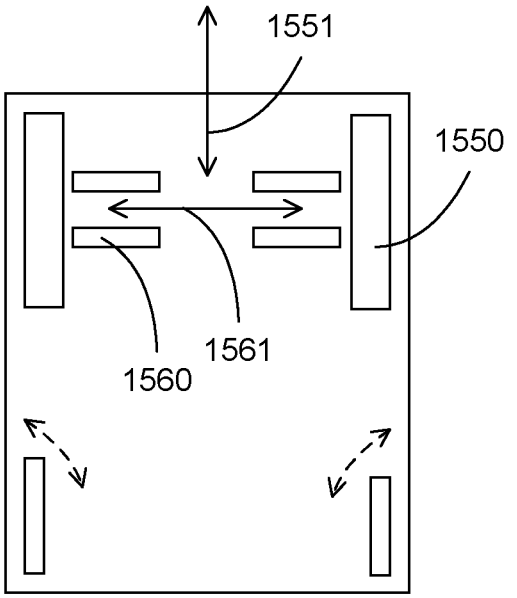

FIG. 15C shows a configuration with a second set of wheels 1560 to allow moving in a direction 1561 perpendicular to the forward/backward direction 1551 determined by the first set of wheels 1550. The second set of wheels can include two sets of closely-positioned parallel wheels 1560. The second set of wheels can be disposed near the first set of wheels 1550. This, when the first set of wheels is deactivated, the second set of wheels can move the cart in the preferred direction without much deviation.

Figure 15D:
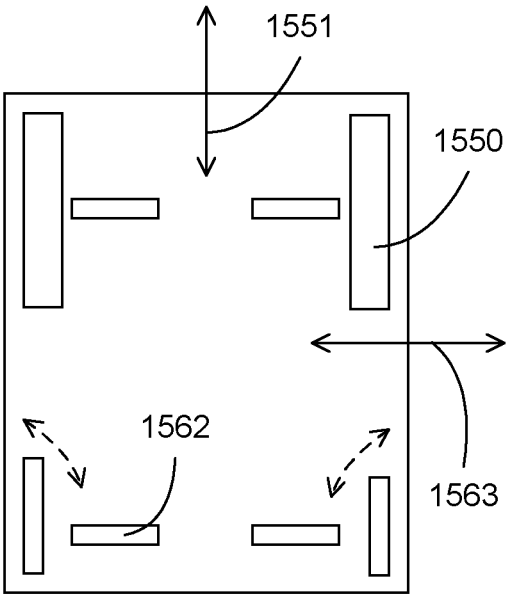

FIG. 15D shows another configuration with a second set of wheels 1562 to allow moving in a direction 1563 perpendicular to the forward/backward direction 1551 determined by the first set of wheels 1550. The second set of wheels can include two sets of separated parallel wheels 1562.

Figure 16A:
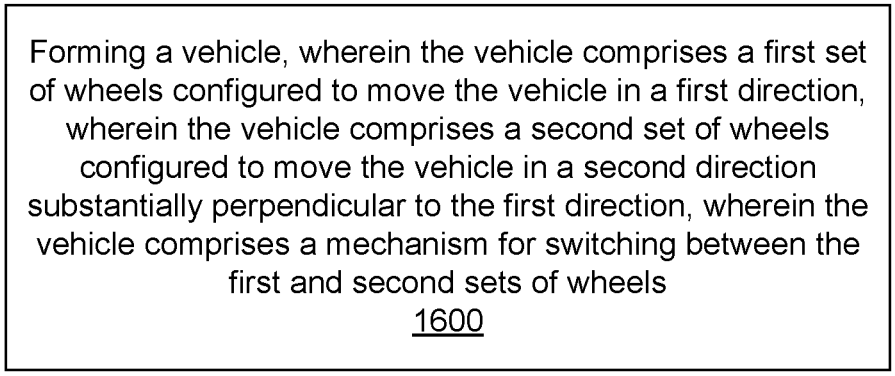
FIGS. 16A-16B illustrate flow charts for lifting carts with perpendicular sets of wheels according to some embodiments.
Figure 16B:
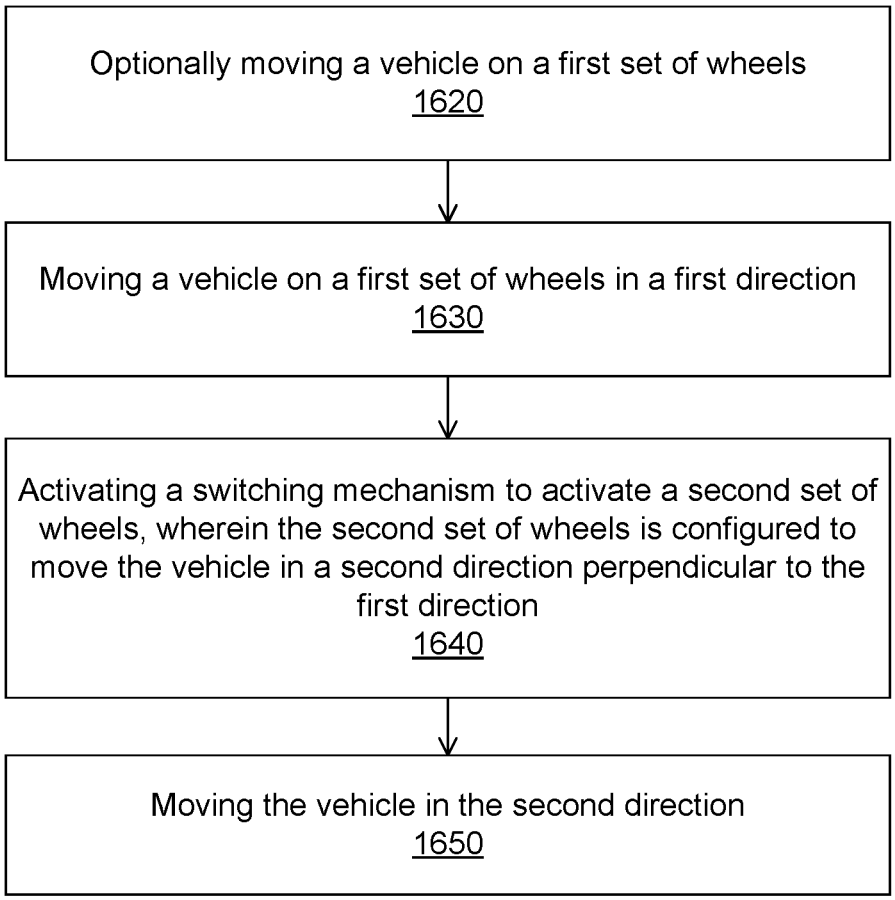

FIGS. 16A-16B illustrate flow charts for lifting carts with perpendicular sets of wheels according to some embodiments. In FIG. 16A, operation 1600 forms a vehicle. The vehicle can include a first set of wheels configured to move the vehicle in a first direction. The vehicle can include a second set of wheels configured to move the vehicle in a second direction substantially perpendicular to the first direction. The vehicle can include a mechanism for switching between the first and second sets of wheels.

In FIG. 16B, operation 1620 optionally moves a vehicle on a first set of wheels. Operation 1620 moves a vehicle on a first set of wheels in a first direction. Operation 1620 activates a switching mechanism to activate a second set of wheels, wherein the second set of wheels is configured to move the vehicle in a second direction perpendicular to the first direction. Operation 1620 moves the vehicle in the second direction.

In some embodiments, the present invention discloses a lifting cart which can be optimized based on a combination of handling mechanism and vehicle movements. The vehicle can be configured to allow moving the wall panels in a horizontal direction, e.g., in a direction parallel to the ground. For example, the vehicle can include 2 steering wheels and 2 following wheels. Other configurations can also be used, such as 2 parallel wheels and one rotatable wheel. The all-direction moving vehicle can move a wall panel from a storage location to an installed location.

The vehicle can be configured to allow aligning of the wall panel in two perpendicular horizontal directions, including a direction parallel to the wall and a direction perpendicular to the wall. For example, once the wall panel is position parallel to the wall, the wall panel can be moved perpendicular to the wall for contacting the edge stop bars, which determine the location of the wall panel in the direction perpendicular to the wall. The wall panel can also be moved in a direction parallel to the wall, for example, to be in contact with the beam or the previous wall panel.

The lifting cart can have a handling mechanism to handle the wall panel in directions excluding the horizontal directions, such as a vertical movement and a rotational movement in a direction parallel to the horizontal direction. The vertical movement can allow an alignment of the wall panel at the wall, e.g., moving the wall panel up or down to adjust the gaps with the ceiling or the floor. The rotational movement can allow the wall panel to be rotated, from a storage position (sideway position or length side facing the ground) to an installed position (upright position or width side facing the ground).

In some embodiments, the vertical movement can be incorporated into the rotational movement. For example, to rotate the wall panel, the wall panel will need to be lifted up to clear the ground before being able to be rotated. The lifting movement can be used as the vertical movement in aligning the wall panel. Thus the handling mechanism can include movements needed to rotate the wall panel, with the vertical alignment movements included in the rotational movements.

Figure 17A:
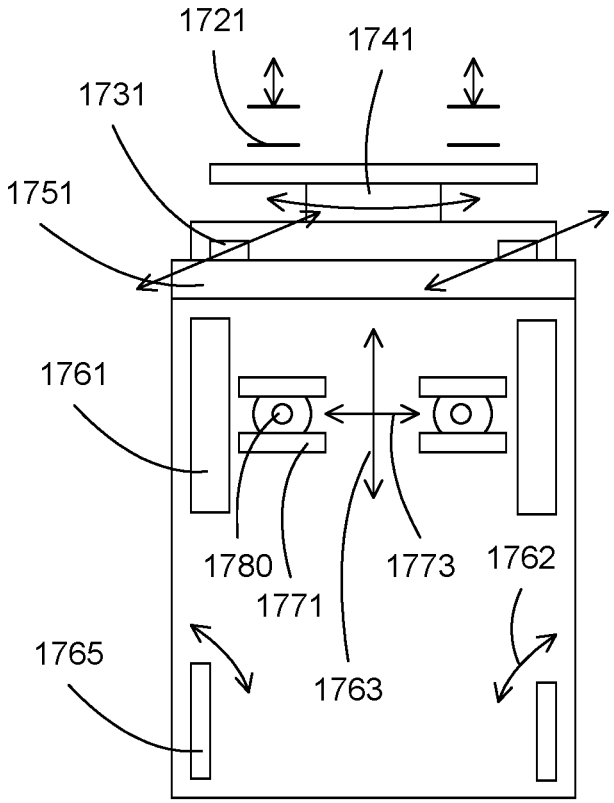
FIGS. 17A-17B illustrate a lifting cart according to some embodiments.
Figure 17B:
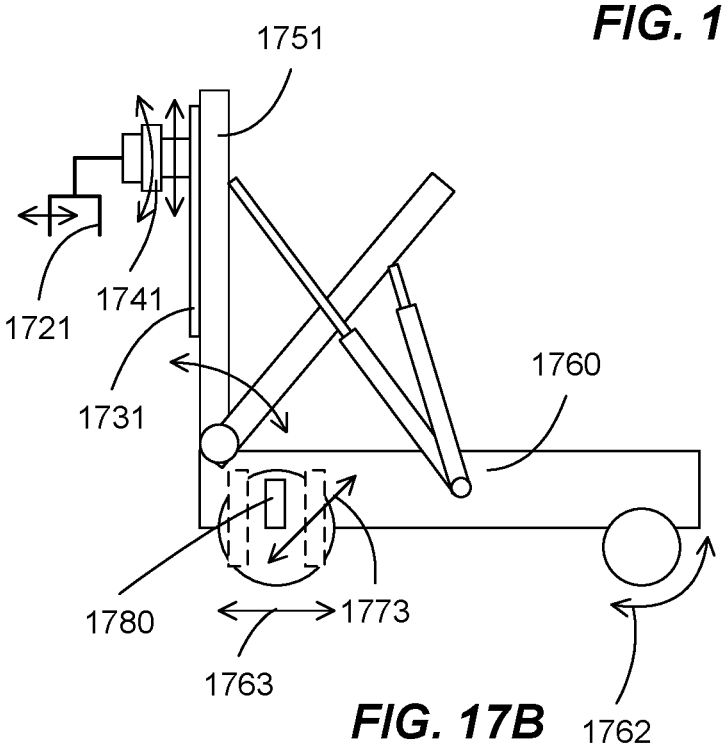

FIGS. 17A-17B illustrate a lifting cart according to some embodiments. FIG. 17A shows a top view, and FIG. 17B shows a side view of a lifting cart. A lifting cart can include a vehicle 1760, which can have two sets of perpendicular wheels 1761 and 1771. A first set of wheels 1761 can be configured to move the vehicle in a forward and backward direction, e.g., the wheels are straight wheels, not rotatable in directions different from the travel direction, e.g., the wheels are not swivel wheels, which allow the vehicle to move in a straight forward/backward direction. The first set of wheels can include two wheels disposed in parallel facing the direction of travel. For short travel distance, the first set of wheels can travel in a straight line. For long travel distance, the first set of wheels can travel in curve line to change the travel direction.

A second set of wheels 1771 is disposed perpendicular to the first set, to allow the vehicle to move in a perpendicular to the forward/backward direction, e.g., to a direction parallel to the wall to align the wall panel with other wall panels. Similar to the first set of wheels, the wheels in the second set of wheels are not rotatable in directions different from the travel direction, e.g., the wheels are not swivel wheels, which allow the vehicle to move in a straight direction perpendicular to the forward/backward direction. The second set of wheels can include two wheels facing a same direction in a same plane, like two wheels of a bicycle. The second set of wheels can include two pairs of parallel wheels facing a same direction for added stability.

An activation mechanism 1780 can be included, to switch between the two sets of wheels. In some embodiments, only one set of wheels can be operated at any one time. For example, in one operating state, the second set of wheels can be off the ground while the first set of wheels contacts the ground. This configuration can allow the cart to move based on the first set of wheels. In another operating state, the first set of wheels can be off the ground while the second set of wheels contacts the ground. This configuration can allow the cart to move based on the second set of wheels.

The activation mechanism can include an element, such as an actuator, a hydraulic cylinder, or a motorized actuator, which can push on the second set of wheels to allow the second set of wheels to touch the ground, and also to lift the first set of wheels from the ground. The element can be retracted, to allow the second set of wheels to be off the ground, exposing the first set of wheels on the ground.

Other wheels can be included, such as swivel wheels 1765, to allow the vehicle to move in all horizontal directions.

A handling mechanism can be included to handle the wall panel. The handling mechanism can include a clamping mechanism 1721, a rotating mechanism 1741, a vertical linear movement mechanism 1731, and an optional tilting mechanism 1751.

FIGS. 18A-18C illustrate flow charts for a lifting cart according to some embodiments. In FIG. 18A, operation 1800 couples a handling mechanism to a movable vehicle, wherein the handling mechanism is configured to move a panel in non-planar directions, wherein the movable vehicle is configured to move the panel in planar directions.

In FIG. 18B, operation 1820 forms a system to assist in handling a wall panel, wherein the system comprises a panel handling assembly coupled to a set of wheels. The panel handling assembly comprises a clamping mechanism for holding the panel, a lifting mechanism for moving the panel in a vertical direction, a rotation mechanism to rotate the panel to a proper orientation for assembly. The set of wheels comprises a wheel assembly configured to move the vehicle in planar directions including a first planar direction, wherein the set of wheels comprises a second wheel assembly configured to move the vehicle in a second planar direction substantially perpendicular to the first planar direction, wherein the vehicle comprises a mechanism for switching between the first and second wheel assemblies.

In FIG. 18C, operation 1840 lifts and rotates a panel using a handling mechanism. Operation 1850 moves the panel in planar directions using a movable vehicle having two perpendicular sets of wheels.

Figure 19:
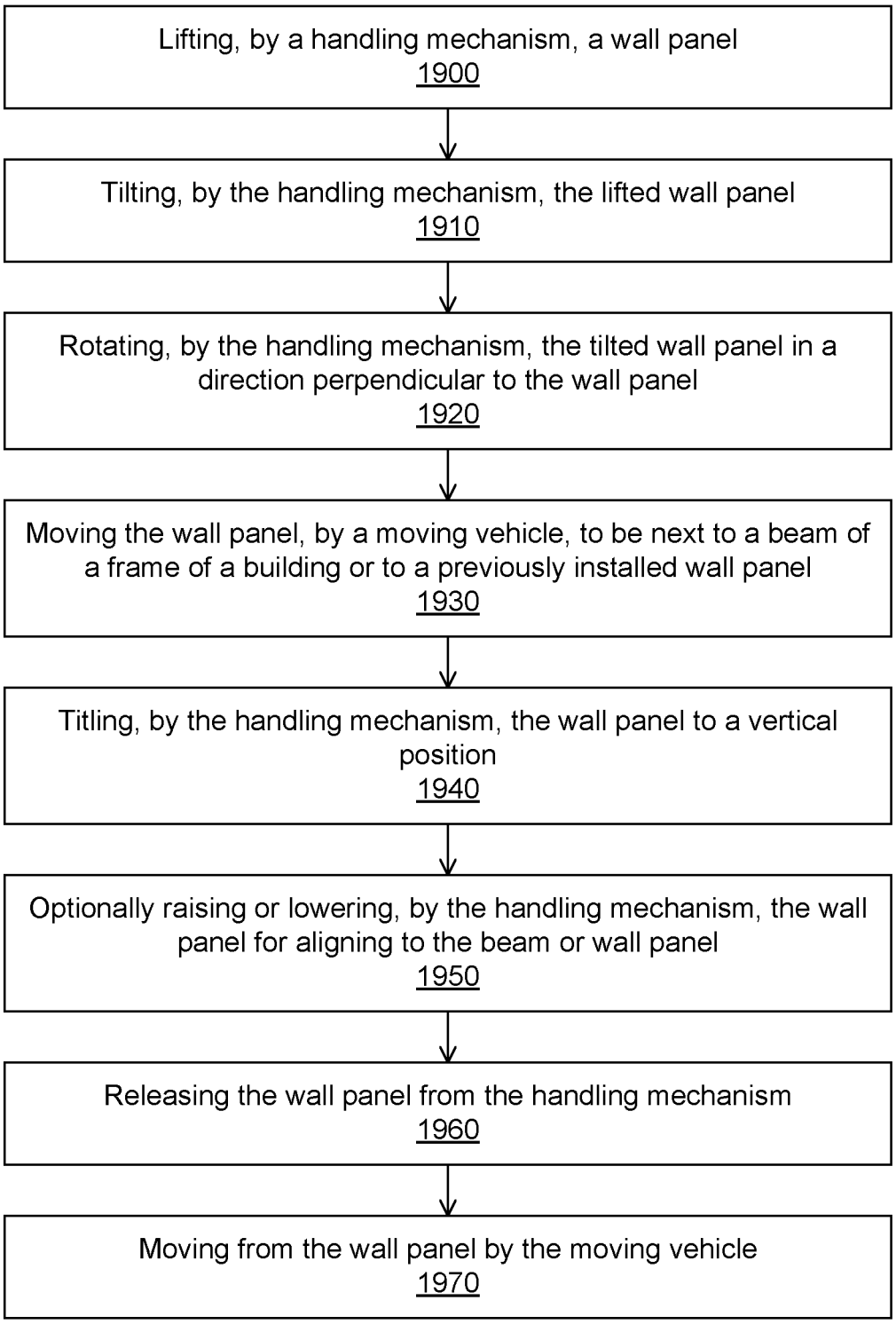
FIG. 19 illustrates a flow chart for a lifting cart according to some embodiments.

FIG. 19 illustrates a flow chart for a lifting cart according to some embodiments. Operation 1900 lifts, by a handling mechanism, a wall panel. Operation 1910 tilts, by the handling mechanism, the lifted wall panel. Operation 1920 rotates, by the handling mechanism, the tilted wall panel in a direction perpendicular to the wall panel. Operation 1930 moves the wall panel, by a moving vehicle, to be next to a beam of a frame of a building or to a previously installed wall panel. Operation 1940 tilts, by the handling mechanism, the wall panel to a vertical position. Operation 1950 optionally raises or lowers, by the handling mechanism, the wall panel for aligning to the beam or wall panel. Operation 1960 releases the wall panel from the handling mechanism. Operation 1970 moves from the wall panel by the moving vehicle.

Figure 20A:
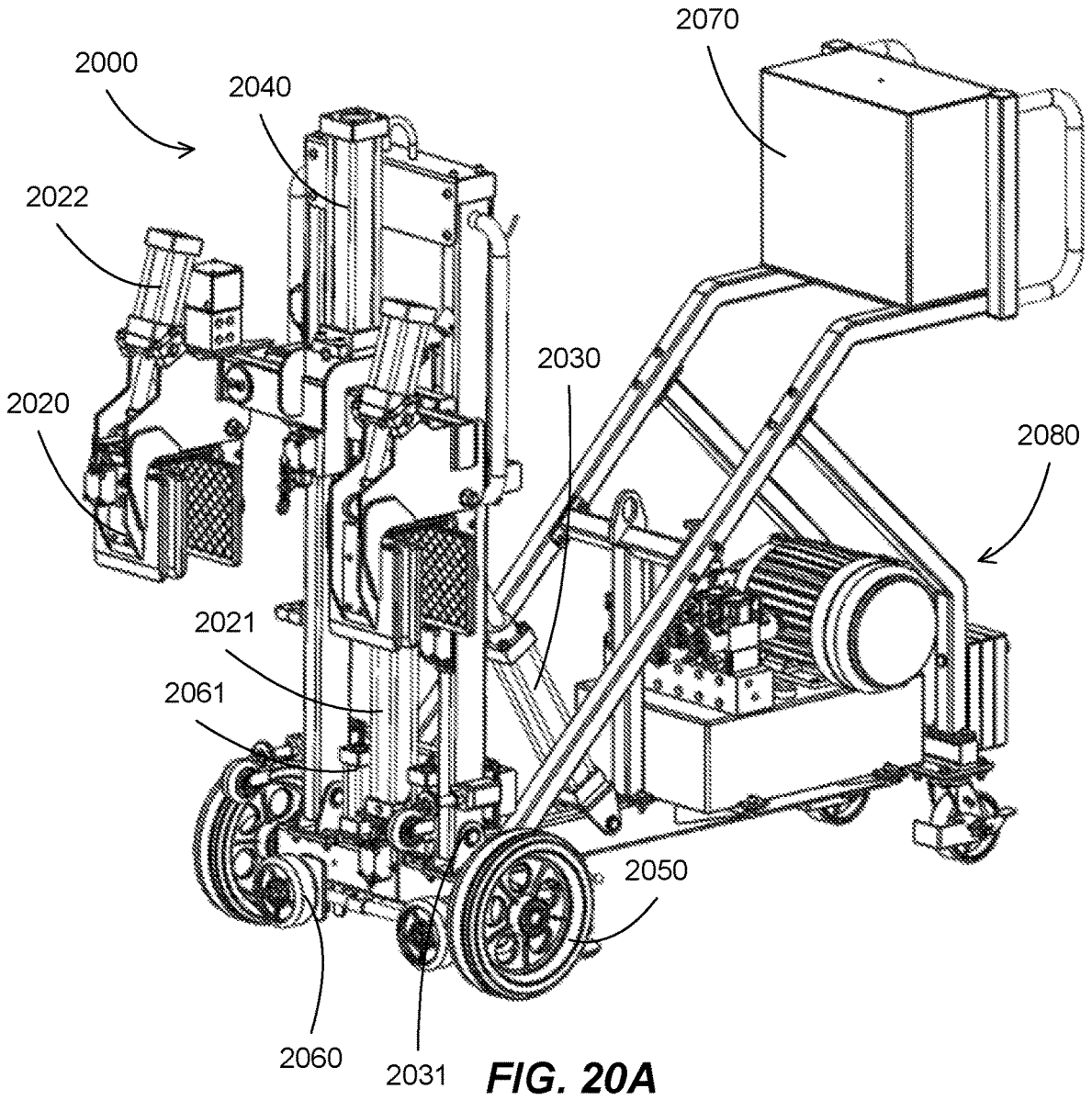
FIGS. 20A-20H illustrate a lifting cart according to some embodiments.

FIGS. 20A-20H illustrate a lifting cart according to some embodiments. FIG. 20A shows a perspective view of a lifting cart 2000. The lifting cart 2000 can include a four wheel vehicle, with 2 front wheels 2050 configured to move the lifting cart forward or backward. Two back wheels can be swivel wheels, which can allow the cart to rotate or turn.

The lifting cart can include a set of perpendicular wheels 2060. The perpendicular wheels can be configured to move the cart in a direction perpendicular to the direction offered by the front wheels 2050. The lifting cart can include an activation mechanism 2061, which can be used to activate or deactivate the perpendicular wheels. The activation mechanism can include a set of hydraulic cylinders, which, when activated, can push the perpendicular wheels 2050 to touch the ground and to lift the forward wheels 2050. The activation mechanism thus can allow the cart to move in the direction set by the perpendicular wheels.

The lifting cart can include two clamps 2020 for clamping on the wall panel. The clamps can be activated, e.g., clamping, or deactivated, e.g., de-clamping, through the hydraulic cylinder 2022.

The lifting cart can include a lifting mechanism 2021, which can lift or lower the clamps 2020. The lifting mechanism can be activated by a cylinder, configured in such as a way so that when the cylinder extends, the clamps are lifted, and when the cylinder retracts, the clamps are lowered. The lifting mechanism can be used to lift the wall panel off the ground, after the wall panel has been clamped by the clamps.

The lifting cart can include a rotating mechanism, which can be activated by cylinder 2040. The rotating mechanism can rotate the clamps, and in turn, rotating the wall panel clamped by the clamps. The rotating mechanism can provide a 90 degree rotation, which can rotate the wall panel from a position in which the longer side is facing the ground to a position in which the shorter side is facing the ground.

The lifting cart can include a tilting mechanism which can be activated by cylinder 2030 to tilt the combination of clamps 2020, lifting mechanism 2021, and rotating mechanism 2040. The tilting mechanism can effectively tilt the wall panel, which is clamped by the clamps, through an axis 2031 of tilting. The tilting mechanism can also be considered as a rotating mechanism, which can rotate the wall panel in a rotational axis perpendicular to the previously mentioned rotating mechanism 2040.

As shown, the lifting cart can be manually operated by a worker, e.g., the worker can move the cart by pushing, pulling, and turning. Further, the worker can activate the perpendicular wheels, and the can push or pull the cart in the direction set by the perpendicular wheels. Other configurations can be used, such as a motorized lifting cart, using an engine or a motor to drive the wheels. The lifting cart can also be controlled remotely, for example, through a handheld controller wire or wirelessly connected to the lifting cart.

The lifting cart can include a power source 2080 for providing power to the mechanisms that control the lifting cart, such as a hydraulic motor to provide pressurized liquid to the cylinders that activate the clamps, the lifting mechanism, the rotating mechanism, the tilting mechanism, and the activation mechanism of the perpendicular wheels. The lifting cart can include a controller 2070, which can be used to control the mechanisms that control the lifting cart. The controller can include individual commands, such as the command to activate or deactivate the perpendicular wheels. The controller can include automatic modes, which can include a set of sequential or concurrent commands.

For example, in an automatic mode, the controller can open the clamps, lower the clamps to reach the wall panel, clamp on the wall panel, lift the wall panel, tilt the wall panel, rotate the wall panel, un-tilt the wall panel (e.g., returning the wall panel to the upright orientation), unclamp the wall panel, and activate the perpendicular wheels. A worker then can push the lifting cart away from the wall panel, releasing the wall panel to be standing at its position to form the wall section. The worker can pull on the lifting cart, and then guide the cart to collect another wall panel.

Alternatively, in another automatic mode, the controller can open the clamps, lower the clamps to reach the wall panel, clamp on the wall panel, lift the wall panel, tilt the wall panel, rotate the wall panel, un-lift the wall panel (e.g., lowering the lifting mechanism, and since the wall panel has been rotated, result in the wall panel moving to a side away from the clamps), un-tilt the wall panel (e.g., returning the wall panel to the upright orientation), unclamp the wall panel, and lift the clamps (e.g., raising the lifting mechanism, and since the wall panel has been rotated, result in the clamps retracted from the wall panel in a sideway motion). A worker then can pull the lifting cart away from the wall panel, releasing the wall panel to be standing at its position to form the wall section. The worker can guide the cart to collect another wall panel.

Figure 20B:
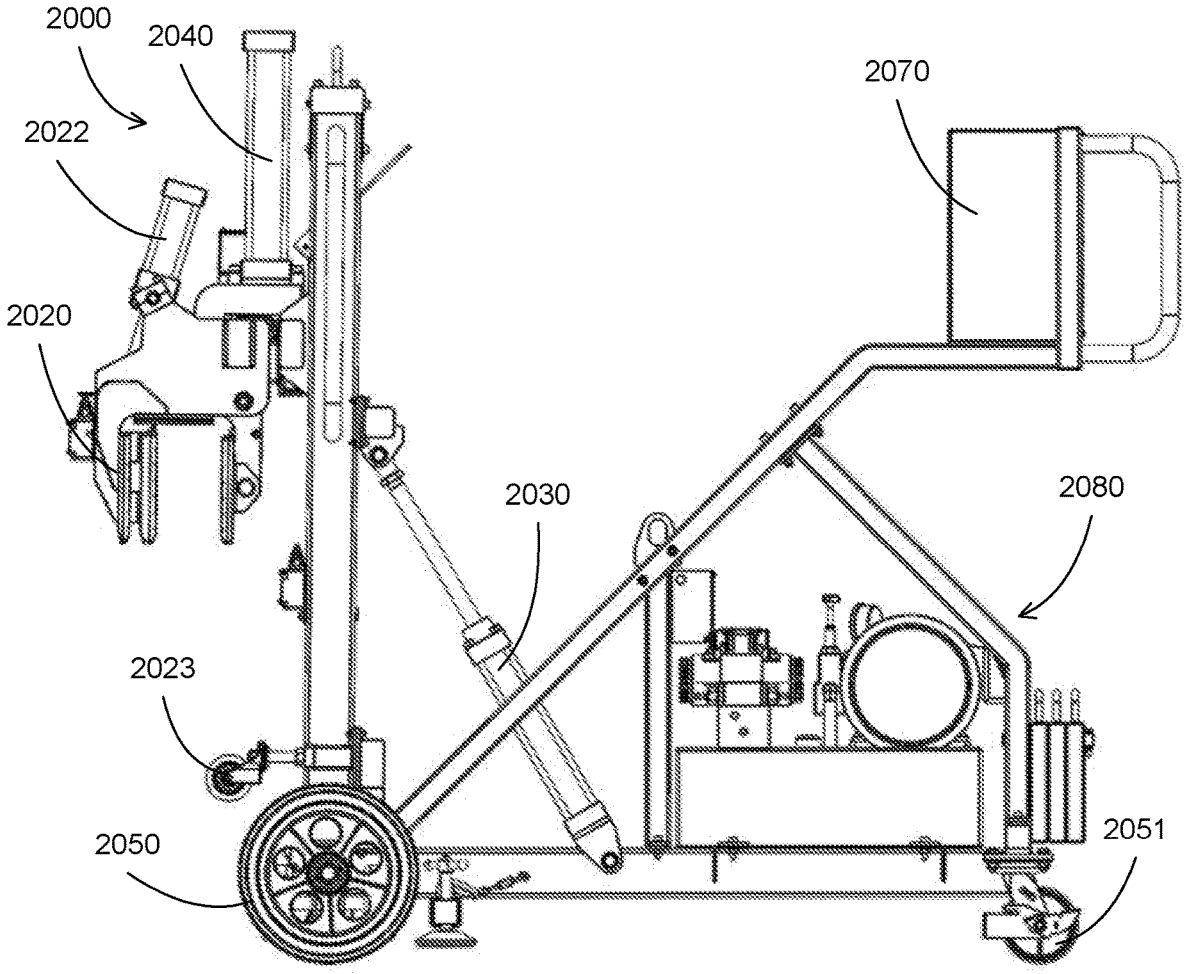

FIG. 20B shows a side view of a lifting cart. A lifting cart 2000 can include a four wheel vehicle, with 2 front wheels 2050 configured to move the lifting cart forward or backward. Two back wheels 2051 can be swivel wheels, which can allow the cart to rotate or turn.

The lifting cart can include a set of perpendicular wheels, which are not shown in the side view.

The lifting cart can include two clamps 2020 for clamping on the wall panel. The clamps can be activated, e.g., clamping, or deactivated, e.g., de-clamping, through the hydraulic cylinder 2022. The lifting cart can include supports 2023, which can be in the form of swivel wheels, for supporting the wall panel that are clamped by the clamps.

The lifting cart can include a lifting mechanism, which is not shown in the side view.

The lifting cart can include a rotating mechanism, which can be activated by cylinder 2040. The rotating mechanism can rotate the clamps, and in turn, rotating the wall panel clamped by the clamps.

The lifting cart can include a tilting mechanism which can be activated by cylinder 2030 to tilt the combination of clamps 2020, lifting mechanism, and rotating mechanism 2040.

The lifting cart can include a power source 2080 for providing power to the mechanisms that control the lifting cart. The lifting cart can include a controller 2070, which can be used to control the mechanisms that control the lifting cart.

Figure 20C:
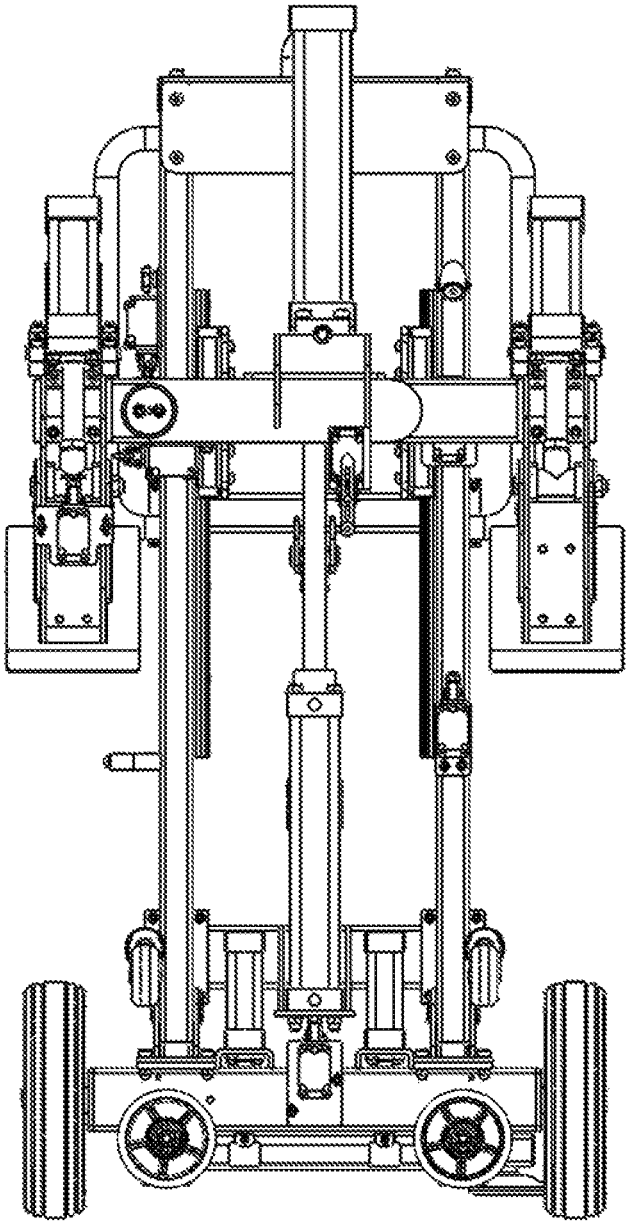

FIG. 20C shows a front view of a lifting cart.

Figure 20D:
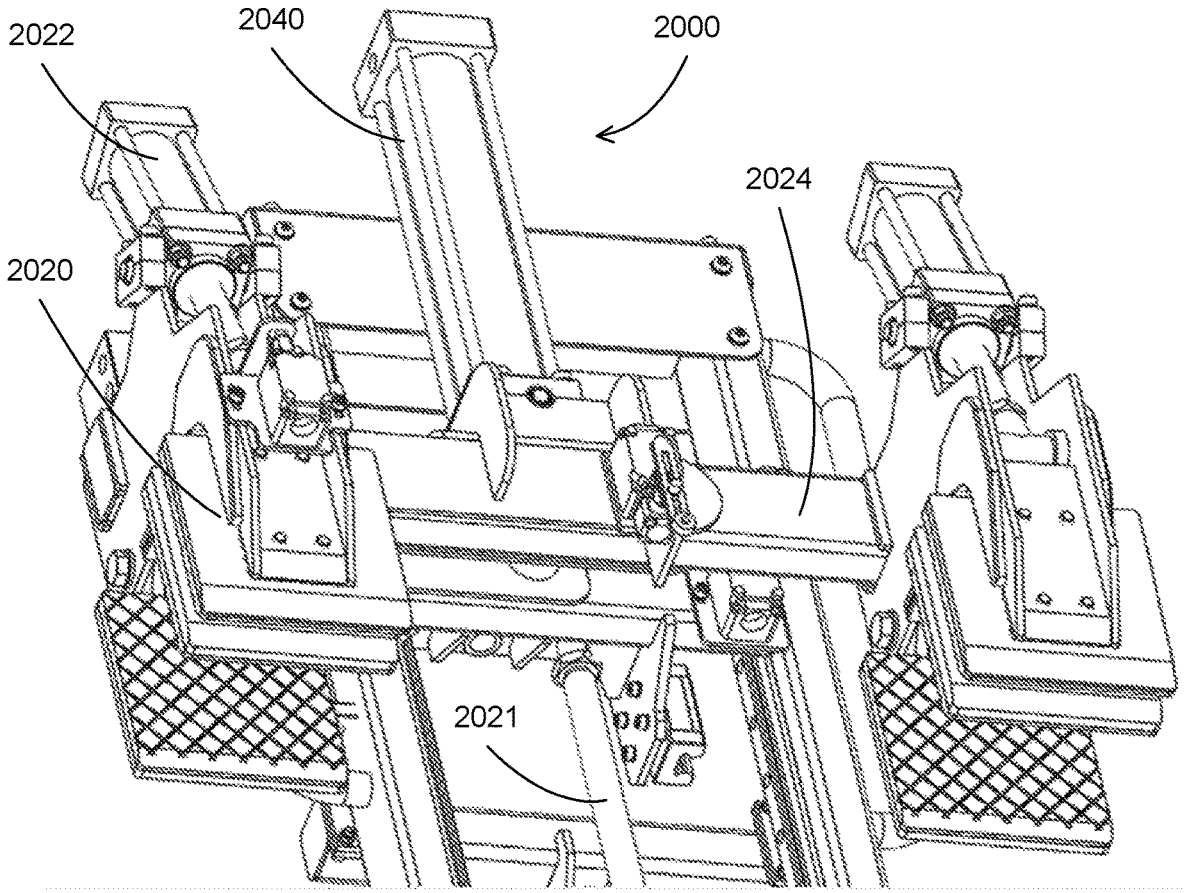

FIG. 20D shows a portion of a lifting cart. A lifting cart 2000 can include two clamps 2020 for clamping on the wall panel. The clamps can be activated, e.g., clamping, or deactivated, e.g., de-clamping, through the hydraulic cylinder 2022. A clamp bar 2024 can link the two clamps 2020, thus operations on the clamp bar 2024 can affect the two clamps, such as the lifting mechanism 2021, and the rotating mechanism 2040.

The lifting cart can include a lifting mechanism 2021, which can push or pull on the clamp bar to lift or lower the clamps 2020. The lifting cart can include a rotating mechanism, which can be activated by cylinder 2040. The linear motion of the cylinder 2040 can be translated into a rotating action of the clamp bar 2024, which can rotate the clamps 2020.

Figure 20E:
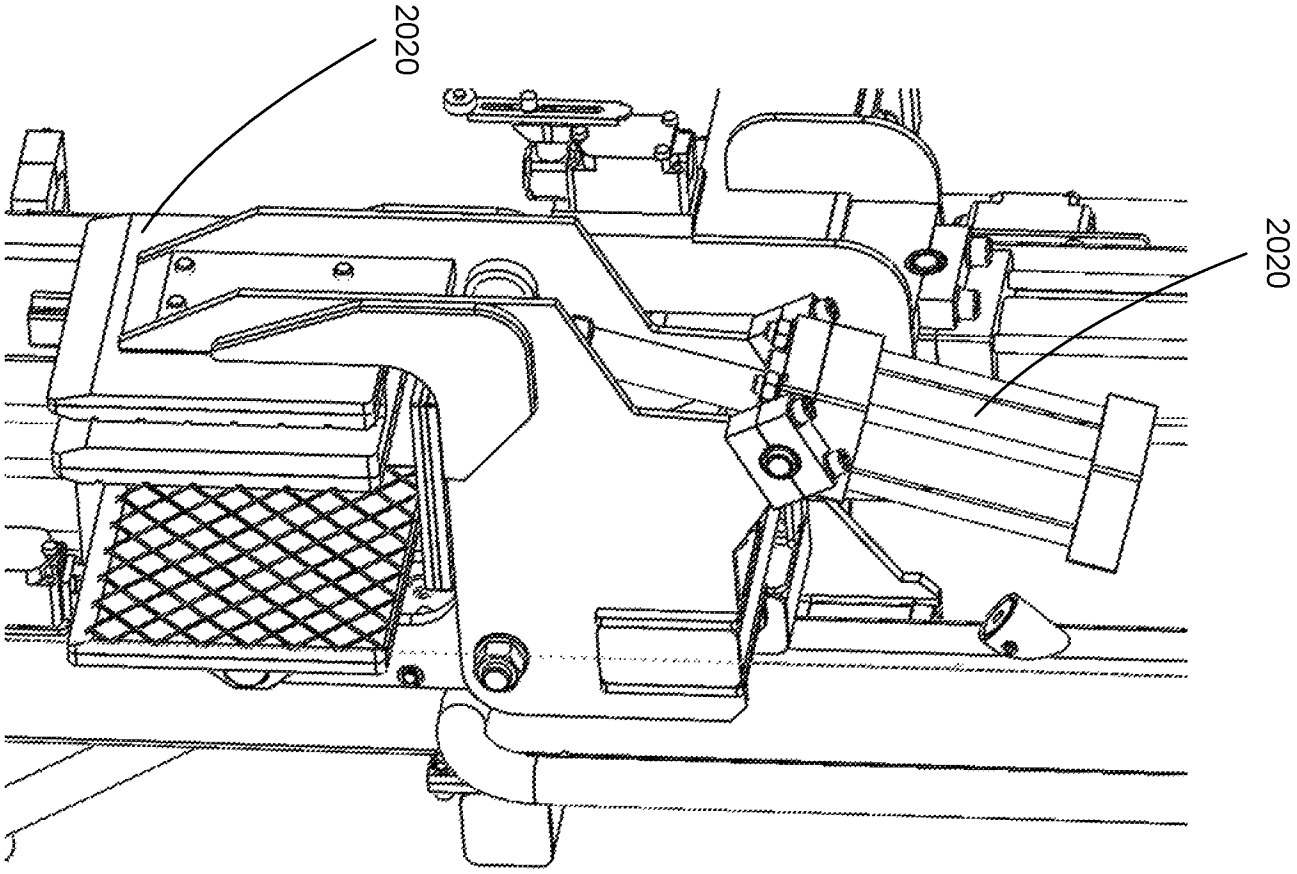

FIG. 20E shows a portion of a clamp mechanism.

Figure 20F:
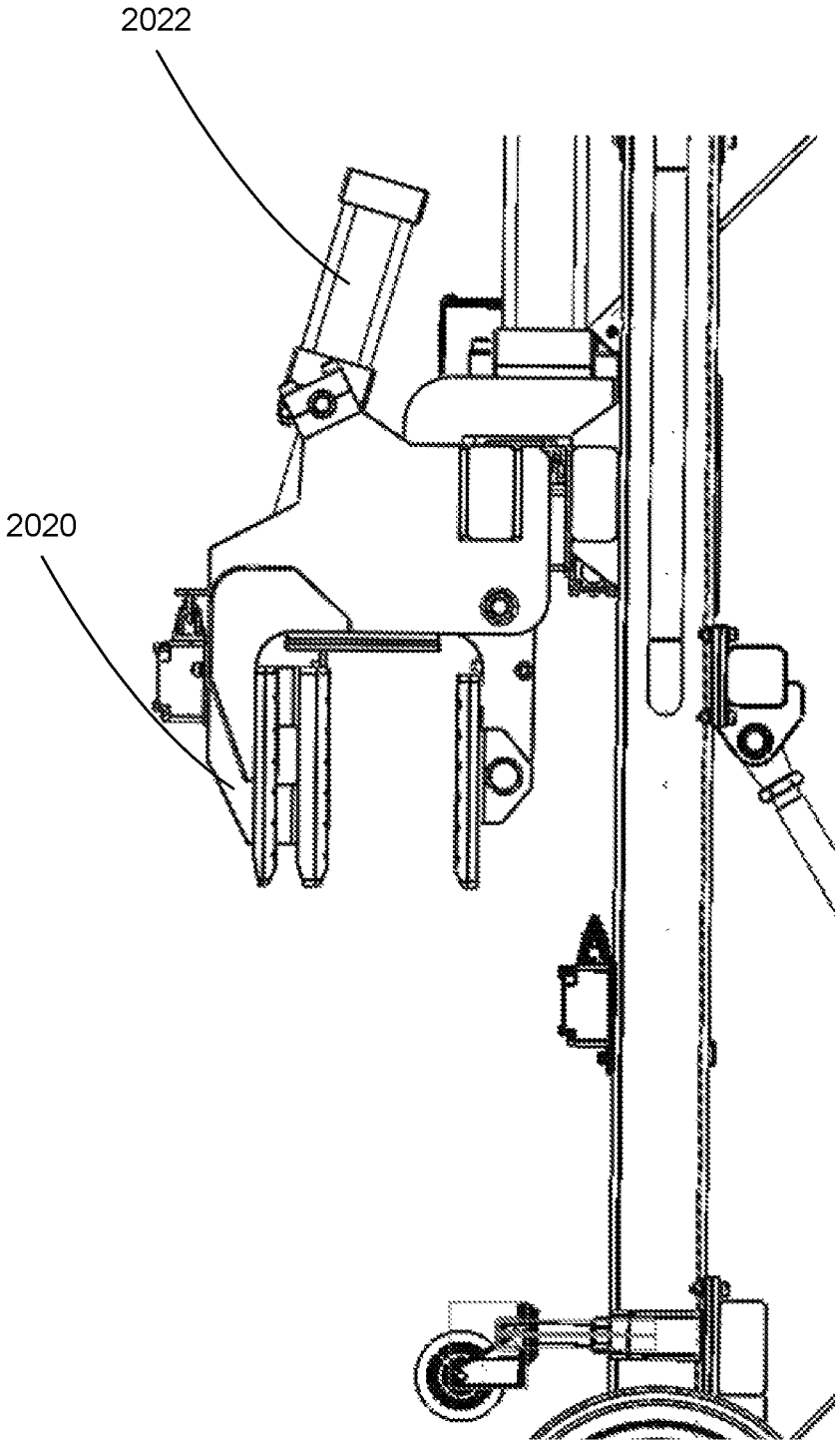

FIG. 20F shows a side view of a clamp mechanism.

Figure 20G:
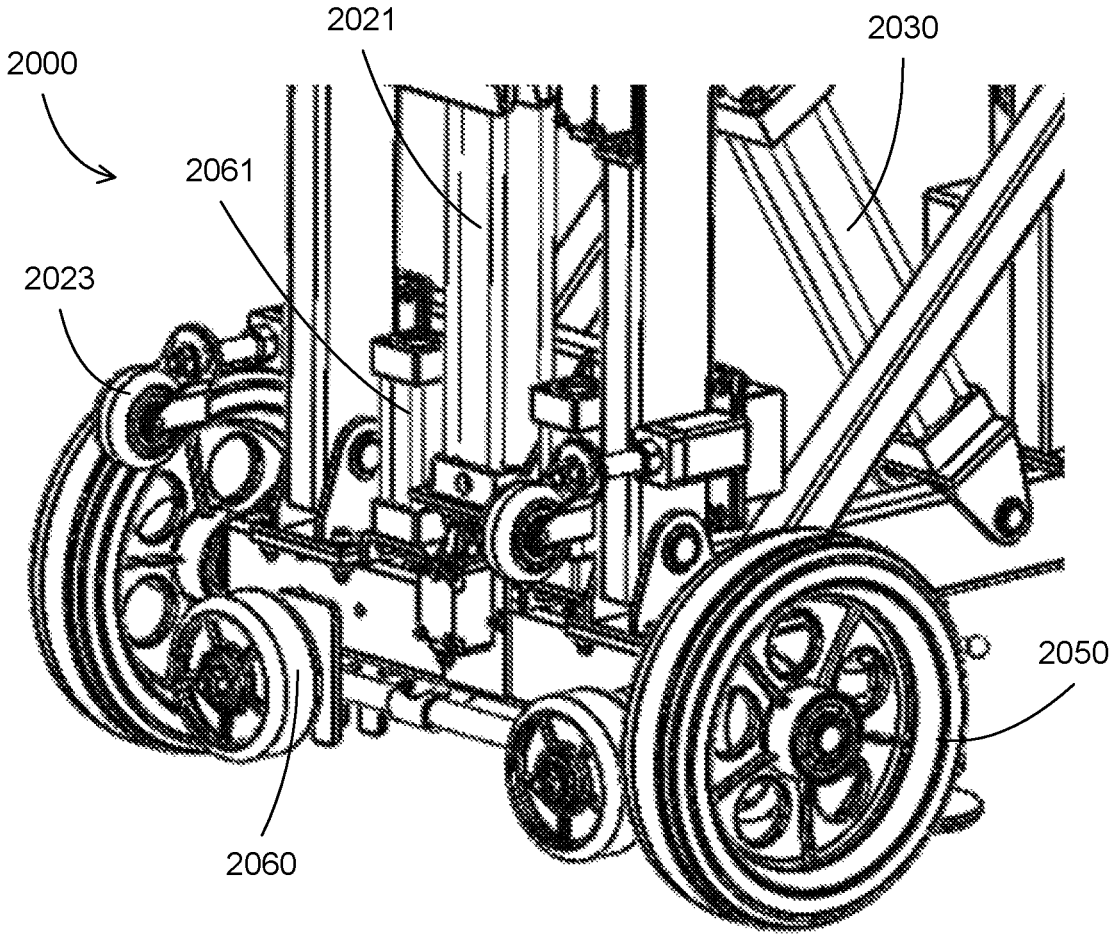

FIG. 20G shows a configuration of moving wheels of a lifting cart. A lifting cart 2000 can include a four wheel vehicle, with 2 front wheels 2050 configured to move the lifting cart forward or backward.

The lifting cart can include a set of perpendicular wheels 2060. The perpendicular wheels can be configured to move the cart in a direction perpendicular to the direction offered by the front wheels 2050. The lifting cart can include an activation mechanism 2061, which can be used to activate or deactivate the perpendicular wheels. The activation mechanism can include a set of hydraulic cylinders, which, when activated, can push the perpendicular wheels 2050 to touch the ground and to lift the forward wheels 2050. The activation mechanism thus can allow the cart to move in the direction set by the perpendicular wheels.

The lifting cart can include two clamps for clamping on the wall panel. The clamps can be activated, e.g., clamping, or deactivated, e.g., de-clamping, through the hydraulic cylinder. The lifting cart can include supports 2023, which can be in the form of swivel wheels, for supporting the wall panel that are clamped by the clamps.

The lifting cart can include a lifting mechanism 2021, which can lift or lower the clamps 2020. The lifting cart can include a tilting mechanism which can be activated by cylinder 2030.

Figure 20H:
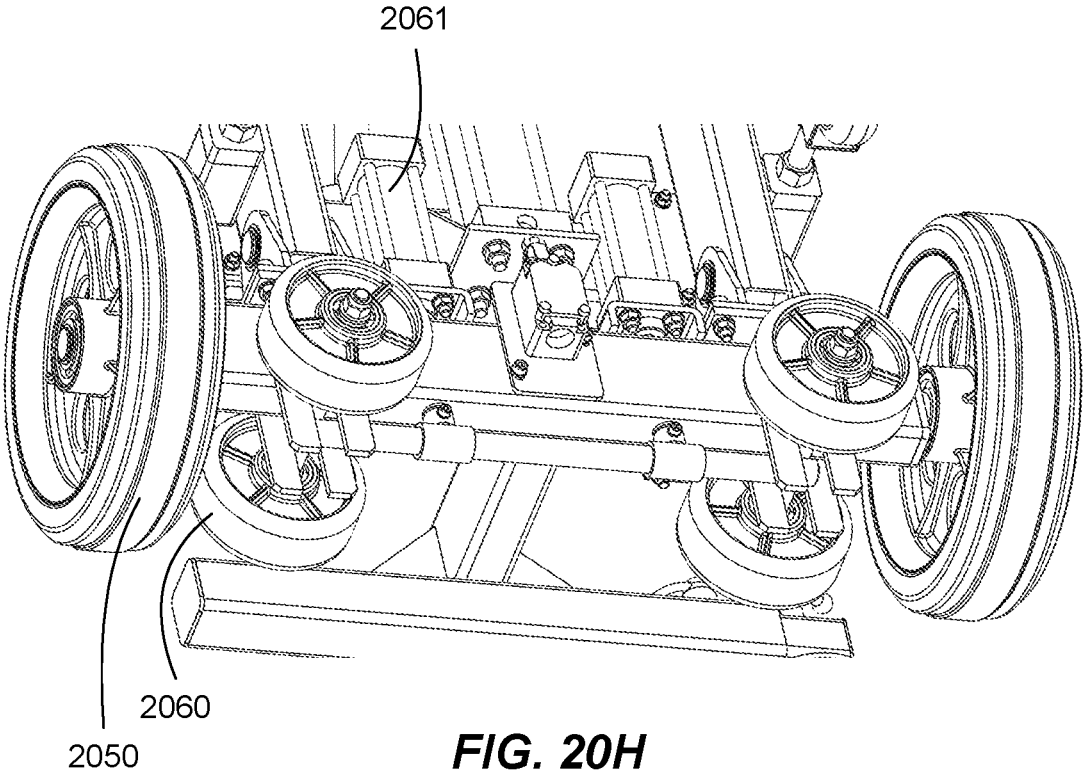

FIG. 20H shows a wheel configuration for the lifting cart. A first set of wheels 2050 and a second set of wheels 2060 can be disposed in perpendicular directions. Activation mechanism 2061 can be used to switch between these sets of wheels. For example, the activation mechanism can include two cylinders for pushing the second set of wheels downward to contact the ground and to lift off the first set of wheels.

What is claimed is:

1. A system comprising a panel handling mechanism coupled to a movable vehicle, wherein the panel handling mechanism comprises a clamp bar linking two clamps with each clamp having a clamping mechanism, wherein the two clamps are configured to be parallel for clamping on a same side of the panel, wherein each clamp comprises two flat jaws, wherein the clamping mechanism comprises a first hydraulic cylinder, wherein the first hydraulic cylinder is coupled to the jaws to move the jaws away from each other with a space between the jaws larger than a thickness of the panel, and to move the jaws toward each other to clamp on the panel, wherein the panel handling mechanism comprises a rotational mechanism for rotating the panel around an axis of rotation having a first direction perpendicular to a plane of the panel, wherein the rotational mechanism comprises a second hydraulic cylinder coupled to the clamp bar to translate a linear motion of the second hydraulic cylinder to a rotating motion of the clamp bar for rotating the panel clamped by the two clamps, wherein the panel handling mechanism comprises a linear mechanism for moving the panel in a second direction parallel to a plane of the panel, wherein the rotational mechanism and the two clamps are mounted on the linear mechanism so that the two clamps and the panel clamped by the two clamps move in the second direction regardless of the rotating angle of the rotational mechanism, wherein the linear mechanism comprises a third hydraulic cylinder mounted on a platform, wherein the panel handling mechanism comprises a tilting mechanism for rotating the panel around an axis of rotation having a third direction parallel to the plane of the panel and perpendicular to the first and second directions, wherein the tilting mechanism comprises a fourth hydraulic cylinder coupled to the movable vehicle to rotate the platform.

2. A system as in claim 1 wherein the rotational mechanism is configured to rotate the clamp bar an angle about 90 degrees.

3. A system as in claim 1 wherein the tilting mechanism is configured to tilt the panel an angle between 40 and 50 degrees.

4. A system as in claim 1 wherein the panel handling mechanism comprises a support configured to support the panel after the panel being clamped by the two clamps.

5. A system as in claim 1 wherein the panel handling mechanism comprises a swivel wheel configured to support the panel after the panel being clamped by the two clamps.

6. A system as in claim 1 wherein the rotational mechanism and the two clamps are mounted on a linear guide of the linear mechanism.

7. A system as in claim 1 wherein the system comprises a controller, wherein the controller is configured to provide individual commands or sets of sequential or concurrent commands for activating or deactivating the clamping mechanism, the rotational mechanism, the linear mechanism, and the tilting mechanism.

8. A system as in claim 1 wherein the movable vehicle comprises two sets of perpendicular wheels for moving the movable vehicle in two perpendicular directions.

* * * * *